US005486849A

United States Patent [19]

Miura et al.

[11] Patent Number: 5,486,849

[45] Date of Patent: Jan. 23, 1996

[54] THERMAL RECORDING DEVICE WITH HEAT EXCHANGER

[75] Inventors: Yasushi Miura, Kawasaki; Haruhiko Moriguchi, Yokohama; Yasushi Murayama, Tokyo; Hideyuki Tanaami, Yokohama, all of Japan

[73] Assignee: Canon Kabushiki Kaisha, Tokyo, Japan

[21] Appl. No.: 681,068

[22] Filed: Apr. 5, 1991

[30] Foreign Application Priority Data

| | | | |
|---|---|---|---|
| Apr. 6, 1990 | [JP] | Japan | 2-090101 |
| Apr. 6, 1990 | [JP] | Japan | 2-090102 |
| Apr. 6, 1990 | [JP] | Japan | 2-090103 |
| Apr. 6, 1990 | [JP] | Japan | 2-090104 |
| Apr. 6, 1990 | [JP] | Japan | 2-090105 |
| Apr. 6, 1990 | [JP] | Japan | 2-090107 |
| Apr. 6, 1990 | [JP] | Japan | 2-090108 |
| Apr. 6, 1990 | [JP] | Japan | 2-090109 |

[51] Int. Cl.[6] ..... B41J 2/01; B41J 2/05; B41J 29/377

[52] U.S. Cl. ..... 347/18; 400/719

[58] Field of Search ..... 346/140 R, 76 PH; 400/719; 165/104.33; 347/18, 223

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,533,927 | 8/1985 | Iwagami et al. | 346/140 R |
| 4,558,333 | 12/1985 | Sugitani et al. | 346/140 R |
| 4,704,620 | 11/1987 | Ichihashi et al. | 346/140 R |
| 4,723,129 | 2/1988 | Endo et al. | 346/1.1 |
| 4,740,796 | 4/1988 | Endo et al. | 346/1.1 |
| 5,231,423 | 7/1993 | Wataya et al. | 346/140 R |

FOREIGN PATENT DOCUMENTS

| | | |
|---|---|---|
| 0218205 | 4/1987 | European Pat. Off. . |
| 57-22070 | 2/1982 | Japan . |
| 57-80067 | 5/1982 | Japan . |
| 57-138963 | 8/1982 | Japan . |
| 61-024465 | 2/1986 | Japan . |
| 62-71682 | 4/1987 | Japan . |
| 63-114663 | 5/1988 | Japan . |
| 63-114664 | 5/1988 | Japan . |

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

A temperature control device comprises a first heat exchange unit, for exchanging heat, which is thermally joined with a recording head for recording onto a recording medium by the use of heat energy, a second heat exchange unit for exchanging heat with the atmosphere, which is connected to the first heat exchange unit, working fluid contained within the first heat exchange unit and the second heat exchange unit, and a partition plate for almost separating the interior of the first heat exchange unit and the second heat exchange unit into a working fluid existing region and a vapor existing region where the working fluid and its vapor component exist together.

5 Claims, 25 Drawing Sheets

| FIG. 14B-1 | FIG. 14B-2 |
|---|---|

THERMAL RECORDING DEVICE WITH HEAT EXCHANGER

BACKGROUND OF THE INVENTION

1. Field of the Invention

The present invention relates to a temperature regulator and a recording apparatus, and more particularly to a recording apparatus having a recording head for recording with the heat generated by heating elements via heat exchange members for exchanging the heat with the recording heat attached thereto, wherein it comprises a temperature regulator for regulating the temperature of the recording head, and a recording head unit provided with the temperature regulator.

2. Related Background Art

An ink jet system, which is included in the recording system for recording by the use of heat energy has various advantages, unlike other systems, such that it enables high-resolution and high-speed recording, and the recording head and apparatus can be constructed relatively inexpensively because recording heads with this system are manufactured in the same process as that for semiconductor devices.

By the way, in a recording apparatus for recording by the use of heat energy, it is commonly observed that heat accumulation occurs along with the progress of recording, and temperature distribution between recording elements is caused owing to the heat accumulation. The occurrence of heat accumulation and temperature distribution may effect the recording characteristic of recording elements, and result in such a problem that density irregularities occur in a recording image, or color balance is disturbed for the color recording.

Such heat accumulation should be considered particularly in an ink jet recording apparatus for recording with ink. That is, some part of the heat energy generated by electro-thermal converters during the recording is used for discharging the ink by causing the state of the ink to change. Another part thereof is transferred to the ink within liquid channels and common liquid chamber. Further, still another part of the heat is conducted to the substrate side where electricity-heat converters are disposed. With such heat transfer, the temperature of ink within the liquid channels and common liquid chamber is varied, thereby correspondingly causing the distribution of ink temperatures between discharge ports.

The variation of ink temperature and other factors may effect the viscosity of ink etc. That is, the ink viscosity in a higher temperature region is made lower than that in a lower temperature region. As a result, the quantity of ink discharged from each discharge port is changed, so that the densities of pixels to be recorded are changed. In this case, if there is some temperature distribution of ink between a plurality of discharge ports, irregularities of density may occur in the recorded image, corresponding to that distribution. For a color image, the color balance may be disturbed.

Such an unevenness of density or color balance which may be caused due to heat accumulation is a conspicuous phenomenon in the full-line type recording head in which a plurality of discharge ports are arranged for recording of one line corresponding to the width of recording paper (e.g., if a recording paper of A3 size is used, 4376 discharge ports and corresponding electricity-heat converters are provided for a recording density of 400 dpi.). Thus, when many discharge ports are arranged, there is a possibility that the temperature distribution may occur between discharge ports due to differences between discharge frequencies of discharge ports. In addition, when the A3-size recording is performed immediately after the B5-size recording is performed using a part of the array of discharge ports, the temperature distribution may occur between discharge ports already used for recording and those not used.

Also, when a plurality of recording heads are used for each color ink in the full-color recording, the temperature differences between recording heads may occur due to the differences between use frequencies of recording heads, causing the dispersion of ink viscosities and thereby slight difference in the volume of ink discharged, so that the color balance is made uneven or ink densities may be different in ink colors.

In order to reduce the temperature distribution between discharge ports of a recording head or the temperature differences between a plurality of recording heads, the present inventor has proposed a arrangement in which heat exchange member such as heat pipe is attached to recording head to exchange the heat via the heat pipe.

In this arrangement, the heat pipe is provided with working fluid such as water within its hollow interior, in which heat exchange (radiation from recording head or heating of recording head) is performed by the working fluid evaporating or condensing depending on the temperature relative to the recording head. The inside of the heat pipe is filled with the working fluid and its vapor evaporated therefrom, and by the rapid heat transfer of vapor, the heat pipe is always subjected to the action for equalizing the temperature.

In order to promote the heat exchange by means of the heat pipe, the present inventor has also proposed a heat exchange device such as fins for performing the heat exchange (radiation) positively to the atmosphere or a fan for sending the air and provided in a portion to which the heat pipe extends, or a constitution for performing the heat exchange (heating the heat pipe) with the heat pipe by means of heater provided on a predetermined position of the heat pipe.

However, the heat exchange member as above described and the recording head attached includes following possible improvements as described below, in connection with heat exchange member itself and a recording head unit constitution using the heat exchange.

That is, the improvement in the efficiency of heat exchange using the heat exchange member such as heat pipe can reduce rapidly the temperature differences between discharge ports in recording head or between recording heads, thereby providing not only the high-speed recording without unevenness or density, but also the higher speed and improved precision of the head temperature regulation and control for controlling the temperature of recording head within a predetermined range. Further, as the heat exchange efficiency is improved, the effects can be obtained such that the size of the heat exchange apparatus can be made smaller.

In such heat exchange apparatus, main portions contributing to the improvement of its efficiency are a region where the heat pipe as previously mentioned performs heat exchange with the recording head, a region where fins are provided in the heat pipe to radiate the heat to the atmosphere, and a region where a heater is provided in the heat pipe. It is particularly important to operate the heat pipe itself efficiently. The working fluid and its vapor evaporated therefrom are filled in the heat pipe and associated passages, in which the heat exchange with the subject is made using either the evaporation of working fluid or the condensation of its vapor.

In a conventional heat pipe, for example, in order to promote the movement of working fluid within the heat pipe, channels should be provided in its internal wall, but a problem arose such that the processing of heat pipe would be more complicated.

Also, in the conventional heat pipe, a problem existed that the heat radiation with the vapor in heat exchange unit only for radiating the heat might effect the temperature of the other heated radiation units, thereby reducing the efficiency of heat exchange in the heat pipe.

The region where the fan is provided in the heat pipe is also important. This region is one in which the radiation efficiency is to be improved, but there are some cases where full advantage cannot be taken of the fan, and particularly, in a situation where the heat radiation is promoted by the air flow around the fins occurring by means of the fan, the feature of the fins can not be fully exploited.

That is, there was a problem that the air flow may not reach some fins, and so sufficient heat radiation can not be effected from those fins.

There are some instances of requiring smaller fins because of small-sized apparatus, thereby the radiation efficiency of the fins must be increased by the sufficient use of the feature for the fins.

Moreover, when a plurality of recording heads are used, such as in a recording apparatus for full-color recording, the heat exchange member as above described is provided for each recording head.

In such a case, in order to control the temperature of each recording head via the heat exchange member, a heater as a heating element or temperature sensor as temperature sensing element must be provided for each heat exchange member. As a result, the apparatus for the temperature control is made more complicated and expensive.

The present invention is to resolve the above-mentioned conventional problems associated with the heat pipe and peripheral portions thereof, wherein an object of the invention is to provide a recording head unit and a recording apparatus capable of performing efficient heat exchange by fully exploiting the features of a heat pipe comprising a portion filled with the working fluid and a portion filled with the vapor, which are separated by a partition plate.

Also it is an object of the present invention to provide a temperature control device, a recording head unit and a recording apparatus capable of improving the heat radiation efficiency all over the fins, in which the fins attached to heat radiation portion of heat pipe are provided with slits and slit plates for introducing a part of the air flow around the fins to the slits, thereby creating a turbulent flow state around the fins and increasing the whole area of fins with the slit plates.

Further, it is an object of the present invention to provide a recording apparatus capable of controlling the temperature of recording head with a simple constitution, in which the heat change members provided corresponding to a plurality of recording heads communicate with one another at predetermined portions and are formed integrally, and temperature sensing element and heating elements are provided in the vicinity of an integrated portion of the heat exchange members.

Also, it is another object of the invention to provide a temperature regulator, a recording head unit and a recording apparatus capable of controlling the temperature in accordance with the temperature of individual recording heads corresponding to each of the heat exchange members, even if the integrated heat exchange members as above described are used.

On the other hand, in an ink jet recording apparatus comprising the recording head as above described, the ink is discharged through discharge ports 5 with the pressure caused by bubbles generated in the ink in contact with elements 3 by the heat from heating elements, whereas in the recording head as above described, the amount of heat transfer to the heat pipe or heat exchange means becomes so large (because the thermal resistance of the heat pipe 2 is small) that the quantity of heat necessary to generate bubbles is insufficient in the heating elements 3, and the ink may not be discharged as fine liquid droplets.

As the heat flux transferred to the heat pipe is concentrated immediately below the heating elements, it is possible that the heat flux exceeding a critical amount of heat transport may flow into the heat pipe, thereby causing an abrupt temperature-up of recording head.

Further, for example, for attachment of the heat pipe to the apparatus, it is preferred that a region where fins are provided in the heat pipe is normally placed away from the area where the recording head is disposed, taking into consideration the effects of the air flow in discharging the ink with the recording head. In this region, high possibility exists that the air flow passing into or out of the fins may be obstructed by the other members constituting the recording apparatus, and particularly, in the small-sized recording apparatus which is one of the recent trends, it is sometimes difficult to lay the fins in a sufficient amount of air flow. Also, when a fan is provided to send the air to the fins, a position for disposing the fan is limited within a certain range by the relation with other members within the recording apparatus, and thereby, the direction or range of air flow is also limited.

On the other hand, in the recording apparatus, the constitution for moving a recording head unit is provided to perform the capping operation for discharge recovery process by supporting integrally the recording head unit composed of recording head and heat pipe.

In such movement, if the recording head and the heat pipe are ill balanced in supporting, a problem may arise such that a relatively large vibration may occur therein, causing the working fluid to be maldistributed within the heat pipe, and an unnecessary load may be applied to driving mechanism for the recording heat unit.

An object of the present invention is to consider and resolve conventional problems as above described, and thereby to provide a recording head unit and a recording apparatus capable of maintaining a stable recording characteristic of the recording head so that the appropriate heat exchange is enabled between the recording head body and the heat exchange means.

The present invention is based on the viewpoints of the heat radiation efficiency and the operation of recording head as above described, and it is an object of the invention to provide a recording apparatus capable of improving the heat exchange efficiency in heat exchange member and making the operation of recording head unit smoother, by application of the present invention to a supporting constitution for the recording head unit.

In addition, in a recording apparatus, such as a color ink jet recording apparatus using the full-line type head, comprising a plurality of ink jet recording heads with the ink discharge ports arranged over the entire width of recording for a recording medium, and the heat pipes as heat exchange means each for exchanging heat with each recording head and provided in contact with almost the whole area along the longitudinal direction for each recording head, the heat pipe is secured onto a side face of each of the recording heads provided in parallel and spaced by a predetermined distance for each other, whereby the spacings between recording heads and the relative positions in the longitudinal direction must be retained precisely with high accuracy. Especially, the spacings between recording heads can affect the capacity of memory involved in recording, and as they should be desirably as little as possible for small-sized recording apparatus, the registration between recording heads is difficult, whereby a problem arises as to how it is accomplished with high accuracy.

As the length of each recording head is great in the direction where discharge ports are arranged, some warpage or distortion may occur in the longitudinal direction, and if the recording is performed in the condition where the warpage exists, a recorded image contains the distortion as shown by broken lines in FIGS. 12A–12C, which may damage the recording quality significantly.

An object of the present invention is to consider and resolve the above-described problems, and thereby to provide an ink jet recording head unit and an ink jet recording apparatus capable of making the fine adjustment of the location in the longitudinal direction for each recording head and/or in the spacing between heads, and the amount of warpage, while heat exchange means are connected and retained therein.

Moreover, as it is common that the recording head and the heat exchange member are securely adhered, the exchange of recording head which is necessary, for example, when the ink is not sufficiently discharged from any one of a plurality of discharge ports, requires the exchange of heat pipe, which will lead to an increased cost of exchange. Also, in the arrangement where the heat pipe must be exchanged as one-piece, the operation for exchange may be sometimes relatively complicated.

On the other hand, in a so-called full-line type recording head, as there are relatively many heating elements, those heating elements are differently deteriorated so that the probability of failure is greater. Thus, the exchange of recording heads is premised to a certain degree on the use of recording apparatus with a full-line type recording head.

The present invention is based on the above-described view-points, and it is an object of the invention to provide a recording head unit and a recording apparatus having a constitution in which recording head and heat exchange member are detachable from each other by means of a biasing member having elasticity.

SUMMARY OF THE INVENTION

It is an object of the present invention to provide a temperature control device comprising;

a first heat exchange unit for exchanging heat, which is thermally jointed with a recording head for recording onto a recording medium by the use of the heat energy;

a second heat exchange unit for exchanging heat with the atmosphere, which is connected to said first heat exchange unit; working fluid contained within said first heat exchange unit and said second heat exchange unit; and a partition plate for almost separating the interior of said first heat exchange unit and said second heat exchange unit into the working fluid existing region and the vapor existing region where said working fluid and its vapor component exist together.

It is another object of the present invention to provide a recording head unit comprising:

a recording head for recording into a recording medium by the use of the heat energy;

a first heat exchange unit for exchanging the heat, which is thermally joined with said recording head;

a second heat exchange unit for exchanging the heat with the atmosphere, which is connected to said first heat exchange unit; working fluid contained within said first heat exchange unit and said second heat exchange unit; and a partition plate for almost separating the interior of said first head exchange unit and said second heat exchange unit into the working fluid existing region and the vapor existing region where said working fluid and its vapor component exist together.

It is a further object of the present invention to provide a recording apparatus comprising, a recording head for recording into a recording medium by the use of the heat energy;

a temperature control device including a first heat exchange unit for exchanging the heat, which is thermally joined with said recording head, a second heat exchange unit for exchanging the heat with the atmosphere, which is connected to said first heat exchange unit, working fluid contained within said first heat exchange unit and said second heat exchange unit, a partition plate for almost separating the interior of said first heat exchange unit and said second heat exchange unit into the working fluid existing region and the vapor existing region where said working fluid and the vapor component of said working fluid exist together, air flow generating means for generating the air flow in the environment of said second heat exchange unit, and heating member attached across an area of said second heat exchange unit where the working fluid and the vapor of said working fluid exist; and control member for controlling the driving of said air flow generating means and the heating member in said temperature control device.

It is an additional object of the present invention to provide a recording head unit for recording onto a recording medium by the use of the heat energy, comprising, a recording head having disposed heating elements for generating said heat energy;

a first heat exchange member for exchanging the heat with said recording head, which is joined with said recording head;

a second heat exchange member for exchanging the heat with the atmosphere, which is provided outside of the area where said recording head is disposed, said second heat exchange member being able to transfer the heat to and from said first heat exchange member;

fins constituting a part of said second heat exchange member and formed with a plurality of slits and slit plates provided on each of said plurality of slits and inclined in plural predetermined directions; and air flow generating means for generating an air flow in said atmosphere of said second heat exchange member including said fins.

It is another object of the present invention to provide a temperature control device for controlling the temperature of recording head having arranged heating elements for generating the heat energy and recording onto a recording medium by the use of said heat energy, said temperature control device comprising, a first heat exchange member for exchanging the heat with said recording head, which is joined with said recording head;

a second heat exchange mender for exchanging the heat with the atmosphere, which is provided outside of the area where said recording head is disposed, said second heat exchange member being able to transfer the heat to and from said first heat exchange member;

fins constituting a part of said second heat exchange member and formed with a plurality of slits and slit plates provided on each of said plurality of slits and inclined in plural predetermined directions; and air flow generating means for generating an air flow in said atmosphere of said second heat exchange member including said fins.

It is another object of the present invention to provide a recording apparatus for recording onto as recording medium by the use of the heat energy, while conveying said recording medium, comprising:

a recording head having disposed heating elements for generating said heat energy;

a first heat exchange member for exchanging the heat with said recording head, which is joined with said recording head; a second heat exchange member for exchanging the heat with the atmosphere, which is provided outside of the area where said recording head is disposed, said second heat exchange member being able to transfer the heat to and from said first heat exchange member;

fins constituting a part of said second heat exchange member and formed with a plurality of slits and slit plates provided on each of said plurality of slits and inclined in plural predetermined directions; and air flow generating means for generating an air flow in said atmosphere of said second heat exchange member including fins.

It is another object of the present invention to provide a recording head unit for recording onto a recording medium by the use of the heat energy, comprising:

a plurality of recording heads having disposed heating elements for generating said heat energy;

a plurality of first heat exchange members for exchanging the heat with said recording head, each of which is joined with each of said plurality of recording heads;

a plurality of second heat exchange members for exchanging the heat with the atmosphere, which are integrated outside of the area where said recording heads are disposed, said second heat exchange members being able to transfer the heat to and from said plurality of first heat exchange member;

heating elements provided in the vicinity of a portion where said first heat exchange member and said second heat exchange member are integral; and a temperature sensing element provided in the vicinity of said integrated portion of said second heat exchange members and on a portion away from the portion where said heating elements are disposed.

It is another object of the present invention to provide a temperature regulator for regulating the temperature of a plurality of recording heads which have disposed heating elements for generating the heat energy, and make the recording onto a recording medium by the use of said heat energy, comprising, a plurality of first heat exchange members for exchanging the heat with said recording heads, each of which is joined with each of said plurality of recording heads;

a plurality of second heat exchange members for exchanging the heat with the atmosphere, which are integrated outside of the area where said recording heads are disposed, said second heat exchange members being able to transfer the heat to and from said plurality of first heat exchange member;

heating elements provided in the vicinity of a portion where said second heat exchange members are integrated; and a temperature sensing element provided in the vicinity of said integrated portion of said second heat exchange members and on a portion away from the portion where said heating elements are disposed.

It is another object of the present invention to provide a recording apparatus for recording onto a recording medium by the use of the heat energy, while conveying said recording medium, comprising, a plurality of recording heads having disposed heating elements for generating said heat energy;

a plurality of first heat exchange member for exchanging the heat with said plurality of recording heads, each of which is joined with each of said plurality of recording heads;

a plurality of second heat exchange members for exchanging the heat with the atmosphere, which are integrated outside of the area where said recording head are disposed, said second heat exchange members being able to transfer the heat to and from said plurality of first heat exchange member;

heating elements provided in the vicinity of a portion where said second heat exchange members are integrated;

a temperature sensing element provided in the vicinity of said integrated portion of said second heat exchange members and on a portion away from the portion where said heating elements are disposed; and control means for controlling the driving of said heating elements in accordance with the temperature sensed by said temperature sensing element.

It is another object of the present invention to provide a recording head unit characterized by comprising:

a recording head having a plurality of heating elements disposed on a substrate and for recording onto a recording medium by the use of the heat energy generated by said heating elements; and heat exchange means including a first heat exchange unit for exchanging the heat with said recording head, which is disposed along the longitudinal direction of said recording head without immediate contact with said substrate region where the heating elements are disposed, and the second heat exchange unit for exchanging the heat at least with the atmosphere, extending from said first heat exchange unit to outside of the recording region of said recording head;

whereby the temperature control of said recording head is allowed via said heat exchange means.

It is another object of the present invention to provide a recording apparatus for recording onto a recording medium by the use of the heat energy, while conveying said recording medium, characterized by comprising:

a recording head having disposed heating elements for generating said heat energy;

a first heat exchange member for exchanging the heat with said recording head, which is joined with said recording head; a second heat exchange member for exchanging the heat with the atmosphere, which is provided outside of the area where said recording head is disposed, said second heat exchange member being able to transfer the heat to and from said first heat exchange member;

a support member for supporting a recording head unit by engaging with at least one of said recording head, said heat exchange member and said second heat exchange member in the vicinity of said recording head unit consisting of said recording head, said first heat exchange member and said second heat exchange member;

driving means for driving said support member and said recording head unit by engaging with said support member; and a capping member for capping said recording head in accordance with the driving of said recording head by driving means.

It is another object of the present invention to provide an ink jet recording head unit with a plurality of recording heads having ink discharge ports arranged in parallel so as to record over almost the entire width of recording medium, comprising heat exchange means including a first heat exchange unit for exchanging the heat with the recording head by having contact with each of said recording heads along its longitudinal direction, and a second heat exchange unit extending from said first heat exchange unit for exchanging the heat at least with the atmosphere, wherein the temperature of said plurality of recording heads can be regulated with said heat exchange means, characterized by providing position adjustment means for adjusting the relative position of each recording head in the longitudinal direction in contact with said first heat exchange unit, and/or spacing adjustment means for adjusting the spacing between adjacent recording heads.

It is another object of the present invention to provide an ink jet recording apparatus with a plurality of recording heads having ink discharge ports arranged in parallel so as to record over almost the entire width of recording medium, comprising heat exchange means including a first heat exchange unit for exchanging the heat with the recording head by having contact with each of said recording heads along its longitudinal direction, and a second heat exchange unit extending from said first heat exchange unit for exchanging the heat at least with the atmosphere, wherein the recording is carried out in such a manner that the temperature of said plurality of recording heads is regulated with said heat exchange means, and the ink is selectively discharged from said ink discharge ports onto said recording medium while said recording medium is moved in the direction orthogonal to the discharge direction of said ink, characterized by providing position adjustment means for adjusting the relative position of each recording head in the longitudinal direction in contact with said first heat exchange unit, and/or spacing adjustment means for adjusting the spacing between adjacent recording heads.

It is another object of the present invention to provide an ink jet recording head unit with a plurality of recording heads having ink discharge ports arranged in parallel so as to record over almost the entire width of recording medium, comprising heat exchange means including a first heat exchange unit for exchanging the heat with said recording head by having contact with each of said recording heads along its longitudinal direction, and a second heat exchange unit for exchanging the heat at least within the atmosphere, wherein the temperature of said plurality of recording heads is regulated with said heat exchange means, characterized by comprising:

position adjustment means for adjusting the relative position of each of said plurality of recording heads in the longitudinal direction, and/or spacing adjustment means for adjusting the spacing between adjacent recording heads; and warpage adjustment means for adjusting the amount of warpage for the recording head so as to be equal between said plurality of recording heads, by engaging with a side face of recording head on almost central portion in its longitudinal direction and exerting the biasing force to said recording head engaged therein in the direction orthogonal to both of said longitudinal direction and ink discharge direction, with each recording head having both end portions supported at predetermined positions via the adjustment of said position adjustment means and/or said spacing adjustment means.

It is another object of the present invention to provide and ink jet recording apparatus with a plurality of recording heads having ink discharge ports arranged in parallel as to record over almost the entire width of recording medium, comprising heat exchange means including a first heat exchange unit for exchanging the heat with the recording head by having contact with each of said recording head along its longitudinal direction, and a second heat exchange unit extending from said first heat exchange unit for exchanging the heat at least with the atmosphere, wherein the recording is carried out in such a manner that the temperature of said plurality of recording heads is regulated with said heat exchange means, and the ink is selectively discharged from said ink discharge ports onto said recording medium while said recording medium is moved in the direction orthogonal to the discharge direction of said ink, characterized by comprising:

position adjustment means for adjusting the relative position of each of said plurality of recording heads in the longitudinal direction, and/or spacing adjustment means for adjusting the spacing between adjacent recording heads; and warpage adjustment means for adjusting the amount of warpage for the recording head so as to be equal between said plurality of recording heads, by engaging with a side face of recording head on almost central portion in its longitudinal direction and exerting the biasing force to said recording head engaged therein in the direction orthogonal to both of said longitudinal direction and ink discharge direction, with each recording head having both end portions supported at predetermined positions via the adjustment of said position adjustment means and/or said spacing adjustment means.

It is another object of the present invention to provide a recording head unit for recording onto a recording medium by the use of the heat energy, characterized by comprising:

a recording head having disposed heating elements for generating said heat energy;

a biasing member having elasticity provided on said recording head; and heat exchange member being relatively carried by said recording head with a biasing force generated by said elasticity of said biasing member, and having a first heat exchange unit for exchanging the heat with said recording head, with is joined with said recording head, and a second heat exchange unit for exchanging the heat with the atmosphere, which is provided outside of the area where said recording head is disposed, said second heat exchange member being able to transfer the heat to and from said first heat exchange member.

It is another object of the present invention to provide a recording apparatus for recording onto a recording medium by the use of the heat energy, while conveying said recording medium, characterized by comprising:

a recording head having disposed heating elements for generating said heat energy;

a biasing member having the elasticity provided on said recording head; and heat exchange member being relatively carried by said recording head with a biasing force generated by said elasticity of said biasing member, and having a first heat exchange unit for exchanging the heat with said recording head, which is joined with said recording head, and a second heat exchange unit for exchanging the heat with the atmosphere, which is provided outside of the area where said recording head is disposed, said second heat exchange member being able to transfer the heat to and from said first heat exchange member.

With the above constitution, the working fluid and its vapor are almost separated by a partition plate, so that respective actions can be performed independently, because the even temperature action with the working fluid is not affected by the temperature change due to the condensation of vapor occurring in a heat radiation unit of heat pipe even if it is transferred all over the interior of the heat pipe by virtue of its rapid head transport.

When the heat pipe is inclined in association with its operation, the deflection of the working fluid within the heat pipe is prevented.

Further, the working fluid is never wiped away with the movement of vapor.

Also, with the above constitution, the air flow around the fins is turbulent due to the existence of the slit plates and slits, and with that turbulent flow, the heat of fins are efficiently radiated without almost any break away in the flow around the fins, so that efficient heat radiation can be effected using all the fins.

With the provision of slit plates, the surface area of fins can be increased, thereby improving the heat radiation efficiency of the fins.

Furthermore, with the above constitution, a construction for the temperature control of recording head can be made simpler, due to the reduced number of heating elements or temperature control elements because they are provided in the vicinity of integral portion of a plurality of heat exchange members.

According to another aspect of the present invention, even when the heat exchange elements as above mentioned are integrated, they can be controlled within a predetermined range of temperature in accordance with the temperature of individual recording heads.

Further, according to the present invention, a stable and suitable recording characteristic can be maintained so as to contribute to the accomplishment of a high quality recorded image in such a manner that a first heat exchange unit of heat exchange means is attached along the longitudinal direction of the recording head without immediate contact with a region where a plurality of heating elements are disposed in substrate of the recording head and the heat exchange is performed at least with the atmosphere via a second heat exchange unit extending from the first heat exchange unit, with the type and thickness of the substrate as above mentioned being set in accordance with the heat energy generated by the heating elements and a heat transport characteristic of the heat pipe.

Also, with the above arrangement, the movement of the atmosphere around the heat pipes and fins, for example, as the second heat exchange member, is not obstructed by support members, so that the heat radiation in the second heat exchange member can be efficiently effected. Particularly, when the air current is generated in the atmosphere as above mentioned by the fan, the improvement of heat radiation becomes more remarkable.

As the support member supports the recording heat unit in the neighborhood of its center of gravity, the relative movement conducted with respect to a recovery unit, for example, in the capping, is made smoother and the working fluid within the heat pipe for example can be always stabilized. Moreover, when the recording head is of a so-called serial type, the scanning movement for recording can be made smoother.

In addition, according to the present invention, respective positions in the longitudinal direction for a plurality of recording heads arranged in parallel are finely adjusted with position regulation means, and the spacings between adjacent heads are finely adjusted with spacing regulation means, and further, warpage of the recording head is eliminated by pressing a side face on a central portion in the longitudinal direction of the recording head via an engaging portion with each recording head by warpage regulation means, thereby subsidiarily contributing to the regulation of spacings, so that the registration adjustment for each recording head and the elimination of warpage allow a high quality recorded image to be obtained.

When it is not necessary to eliminate warpage completely, an adjustment to equalize the amount of warpage for a plurality of recording head can be made.

According to the present invention, when the heat exchange member is secured to the support member, for example, the recording head can be attached by inserting the heat exchange member into a space between the recording head and a presser member provided therein against a pressing force of the presser member, and detached against the above pressing force.

Conversely, when the recording head is secured thereto, the heat exchange member can be inserted or extracted against the pressing force of the presser member provided on the recording head.

DETAILED DESCRIPTION OF THE PREFERRED EMBODIMENTS

Figure 1A:
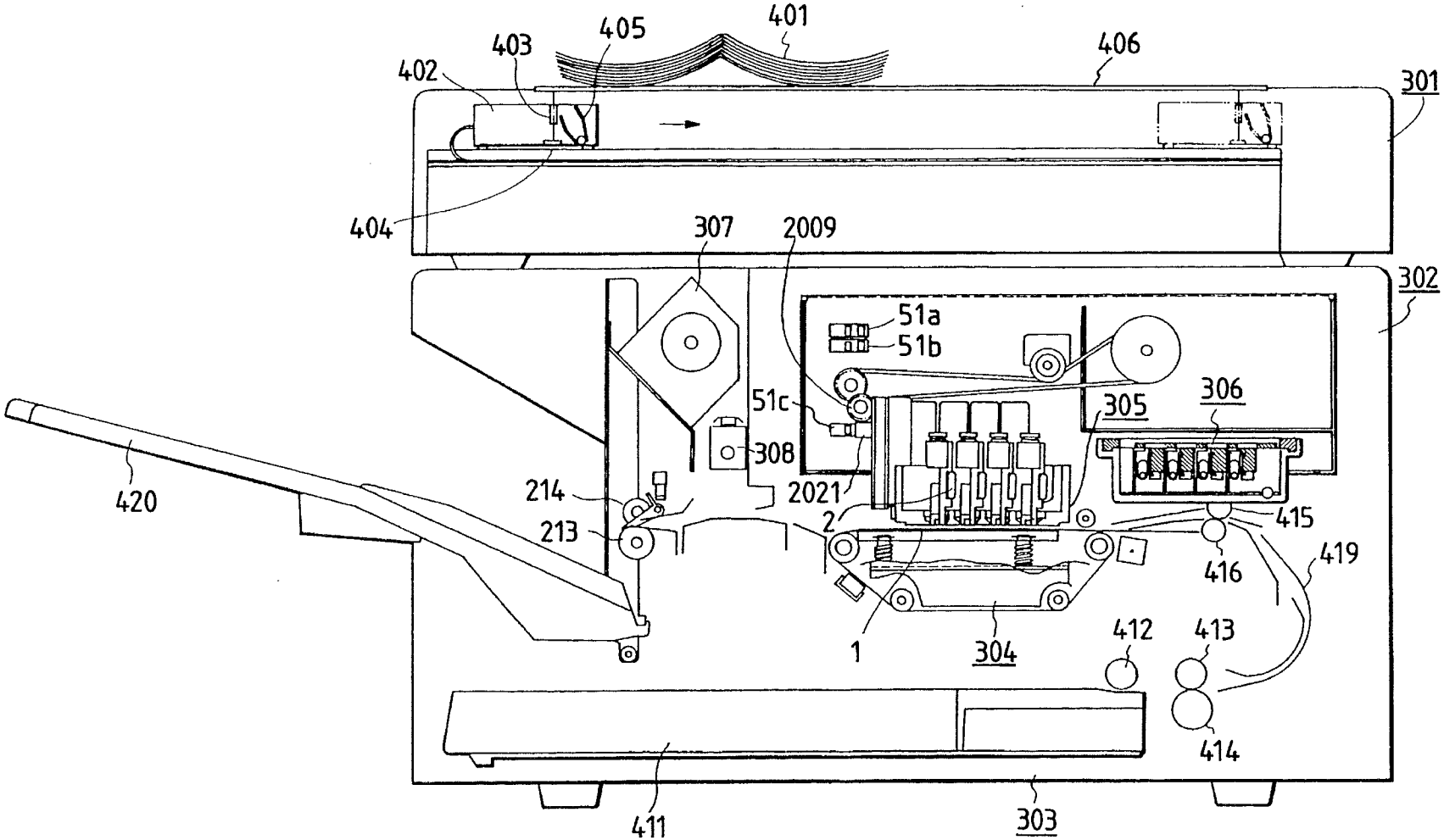
FIGS. 1A, 1B and 1C are a schematic front cross-sectional view, an upper cross-sectional view, and a side cross-sectional view of a copying machine which uses an ink jet recording apparatus according to an example of the present invention, as a recording section, respectively.
Figure 1B:
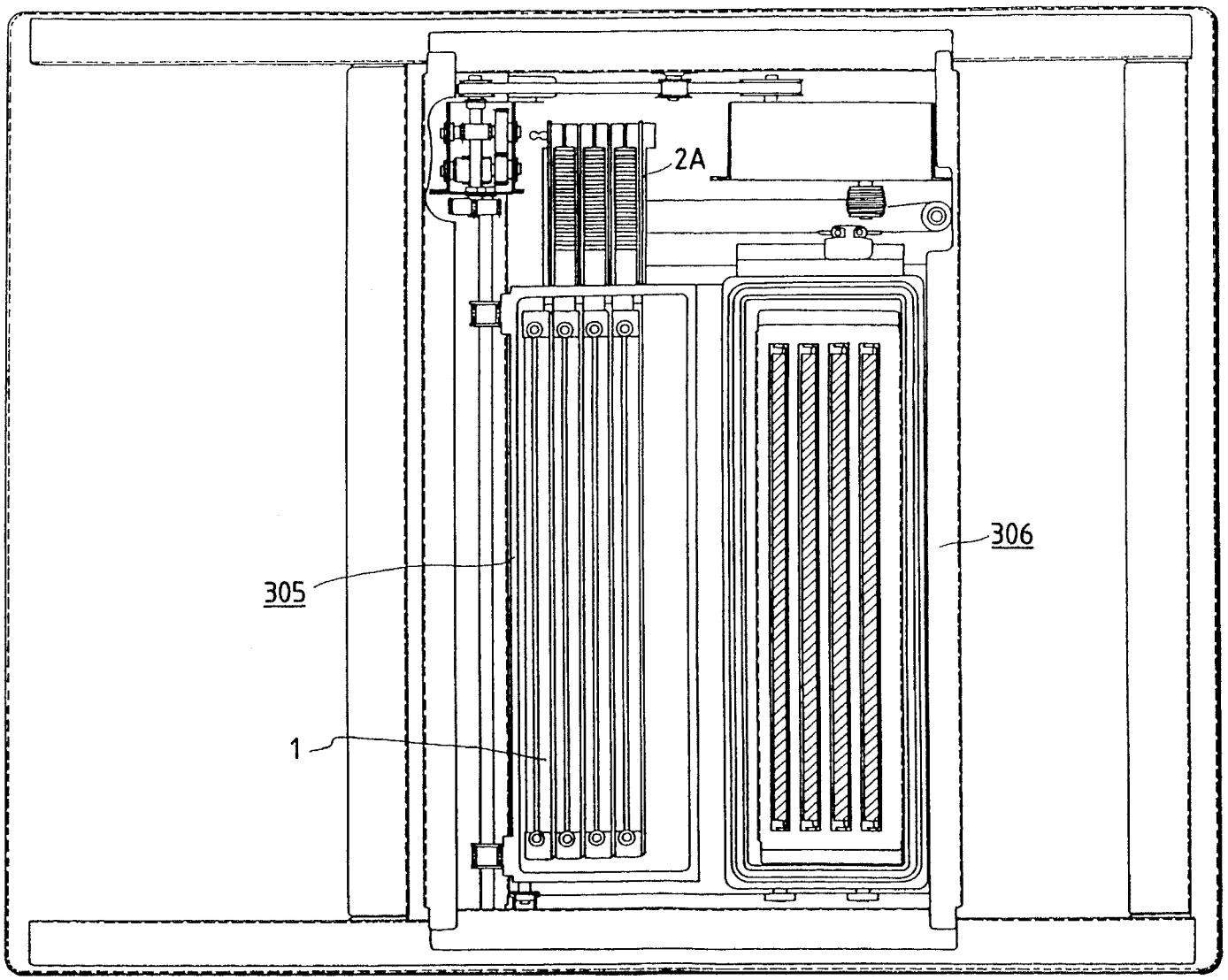
Figure 1C:
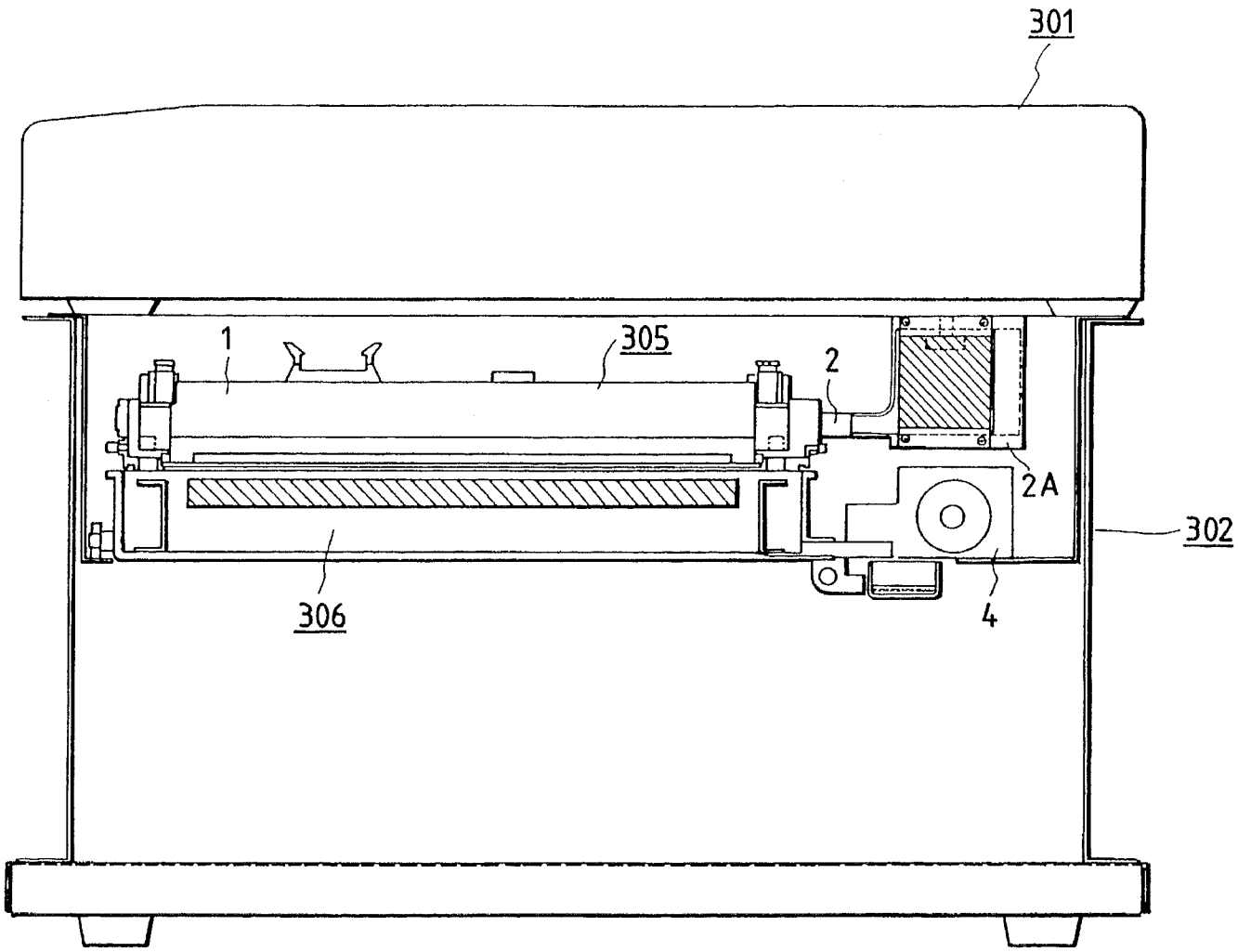

FIGS. 1A, 1B and 1C are views showing a copying machine which uses an ink jet recording apparatus according to an example of the present invention, as a recording section, i.e., a schematic cross-sectional view from the front, a schematic cross-sectional view of only a recording section from the upper side, and a schematic view of the recording section in cross section from the lateral side, respectively.

A copying machine according to the present invention is composed of two main portions. In these figures, 301 is a scanner section for reading an original image and converting it to an electric signal. 302 is a recording section for recording onto a recording medium such as a recording sheet, based on the electric signal converted by the scanner section 301.

In the scanner section 301, 401 is an original, and 406 is a copyboard for placing the original 401 upon, made of a transparent glass. 402 is an original read unit for reading an image of original 401 by moving and scanning. The original read unit 402 contains a rod array lens 403, an equi-magnified color separation line sensor (color image sensor) 404, and exposure means 405. When the original read unit 402 moves for scanning in the direction as indicated by an arrow in the figure, with a scanning movement mechanism, not shown, to read an image of the original 401 on the copyboard 406, an exposure lamp, constituting exposure means 405 of the original read unit 402, is lighted, whereby a reflected light from the image of original 401 to be illuminated is focused on the equi-magnified color separation line sensor (hereafter called a read sensor). The read sensor 404 detects the color image information of original image for each of red (R), green (G) and blue (B), and converts it to electric digital signals. The digital signals are transferred to a printer section 302 as record data.

In the recording section 302, 305 is a recording head unit, comprising a full-line type recording head unit formed with discharge ports over the recording width of a recording medium for each ink of yellow (Y), magenta (M), cyan (C) and black (Bk). On each recording head there is provided a heat pipe 2 disposed on its lateral portion for regulating the temperature of the recording head. Note that the heat pipe of this example is integral therewith at its end portions. 306 is a recovery cap unit for capping a discharge port formation face of the recording head by moving relatively to the recording head unit 305, as will be described later in FIG. 13. Thereby, the ink drying during the non-recording can be prevented, or the predischarge can be effected, to maintain the discharge characteristic of recording head in an excellent condition at all times. In the non-capping state, such as during the recording, the recording head unit 305 is placed at a position opposed to a conveyance passage for recording sheet, as shown in FIGS. 1A and 1B.

303 is a paper feed unit having a cassette 411 for receiving a plurality of recording sheets stacked thereon. Recording sheets received in the cassette 411 are separated into one sheet by a pickup roller 412, which sheet is delivered through recording sheet conveyance passage. The recording sheet delivered is conveyed through a conveyance passage 419 by a pair of conveying rollers 413, 414, and further conveyed to a position opposed to the discharge port face of recording head unit 305 with the conveyance timing adjusted by a pair of resist rollers 415, 416. A recording sheet conveying passage located opposed to the discharge port face is formed by a belt conveyer unit 304. That is, the belt conveyer unit 304 is composed of an endless belt running along the conveyance direction, opposed to the discharge port face, by charging and adsorbing the recording sheet, and a driving unit for driving and running the endless belt. As the recording sheet is conveyed while being adsorbed to the belt, the distance between the recording face and the discharge port face of recording head is adequately maintained. Meanwhile, each of four recording heads for each ink color is driven, based on recording data, for recording onto a recording sheet.

The recording sheet that has been recorded is further conveyed from the position opposed to the recording head unit 305 to a sheet exhausting port. Meanwhile, the air heated by an infrared heater 308 is sent onto the recording sheet on the conveyance passage by a fan 307. Thereby, the evaporation of water content in the ink discharged from the recording head and adhering to the sheet is facilitated to promote the fixing of ink. The recording sheet reaching the sheet exhausting port is exhausted onto a sheet exhaustion tray 420 by a pair of rollers 213,214.

The recording head of the present invention has a heat pipe attached thereto, as previously described, whereby the temperature of the recording head is regulated at a predetermined one. Thereby, the temperature of ink within the recording head can be controlled to be suitable for recording. Thus, as shown in FIGS. 1B and 1C, a part of heat pipe 2 extends beyond a region where the recording head is disposed, to an area where there is arranged the heat exchanger unit composed of fins for radiating the excess heat and a heater for supplying the heat to the recording head. And below the heat exchanger unit, there is provided a fan 4 for sending the air to the fins.

Figure 2A:
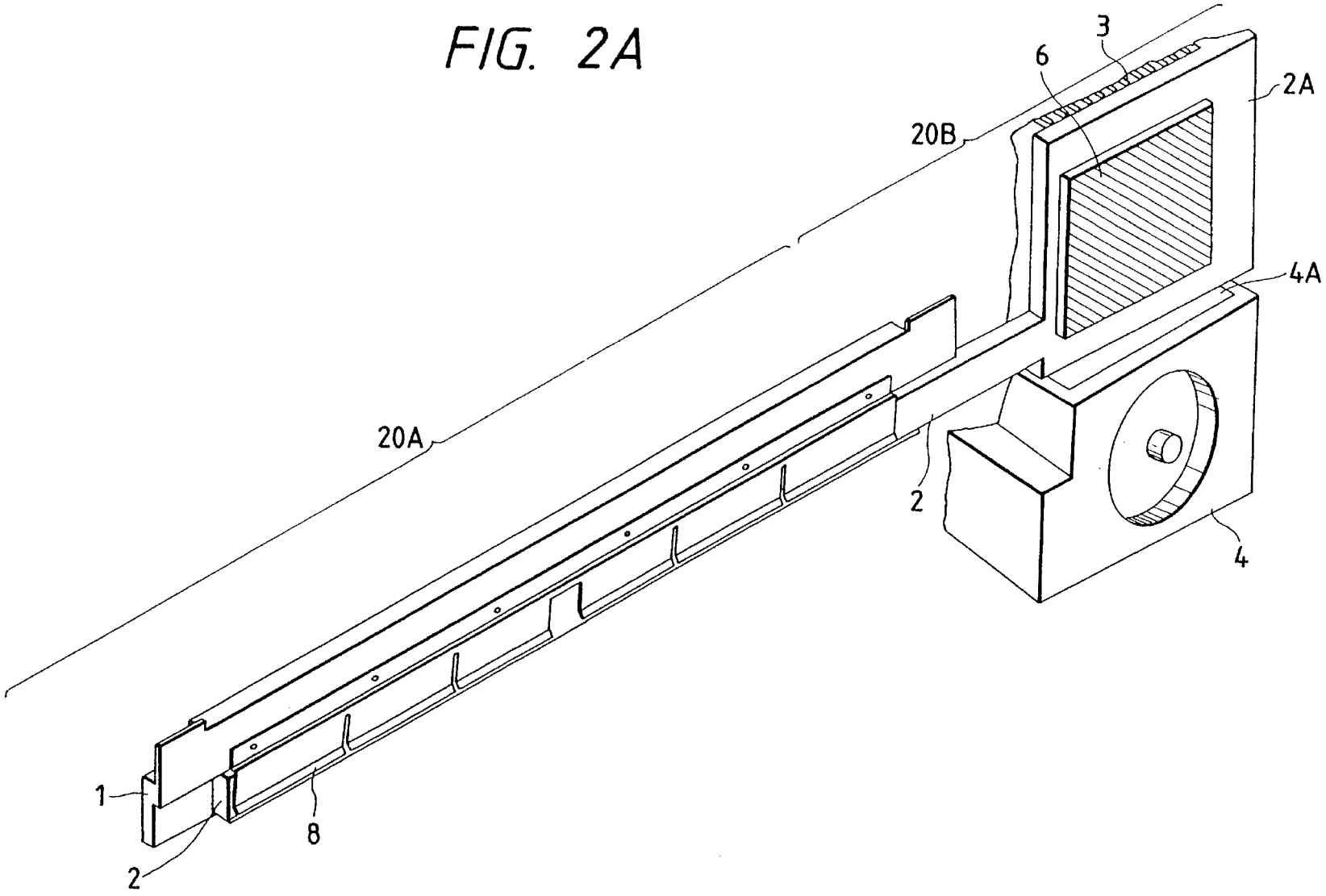
FIGS. 2A, 2B and 2C are a perspective view, an upper view and a side cross-sectional view of a recording head unit composed of a recording head and a heat pipe according to an example of the present invention, respectively.
Figure 2B:
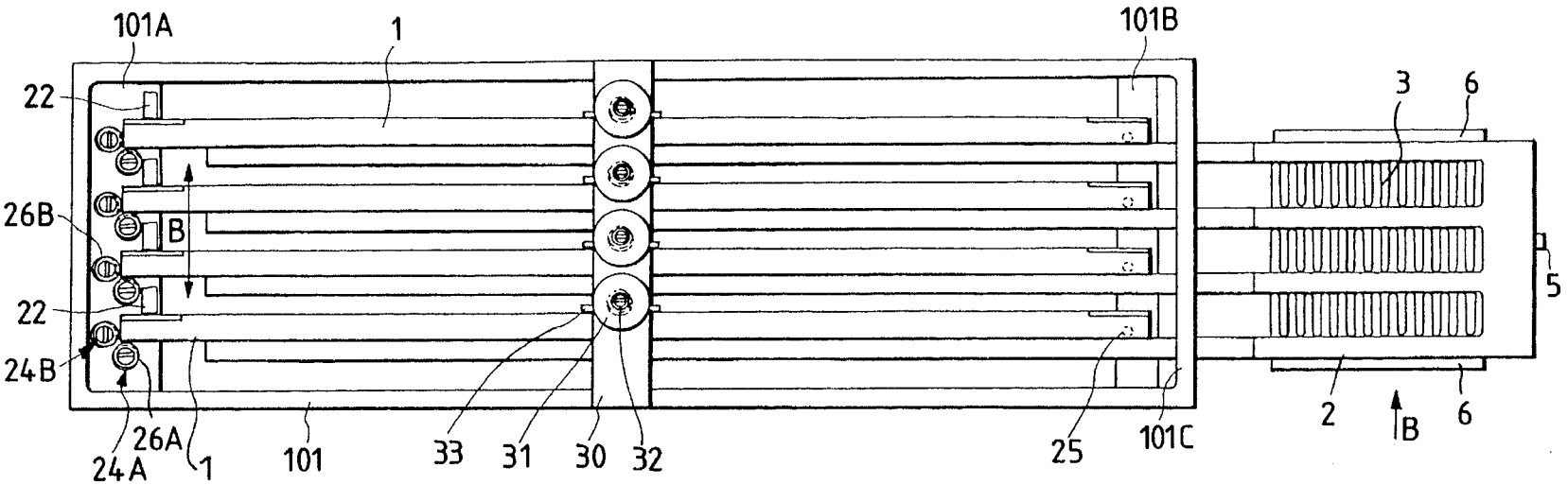
Figure 2C:
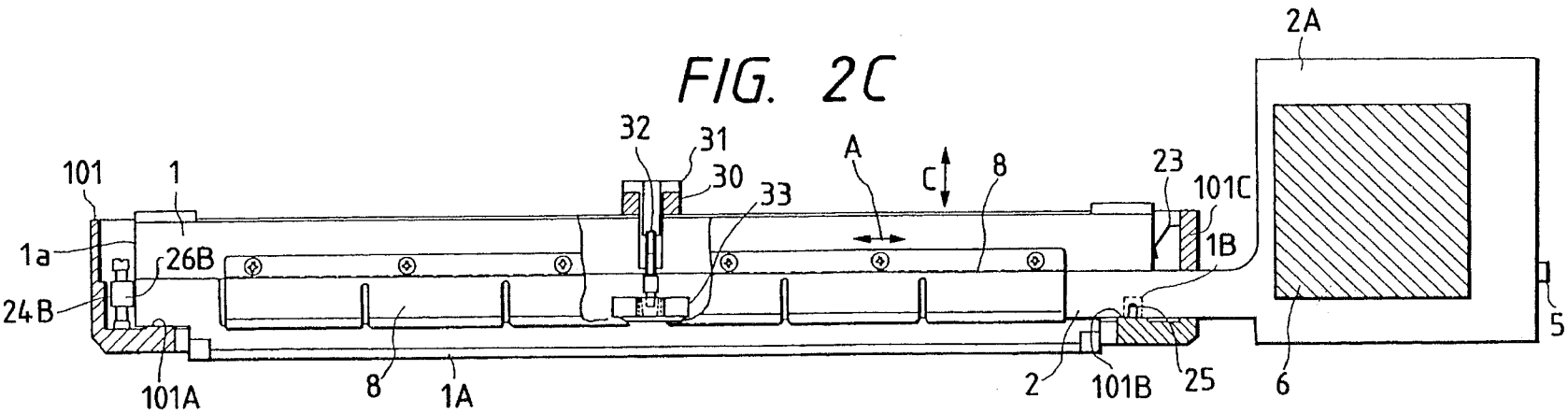
Figure 14A:
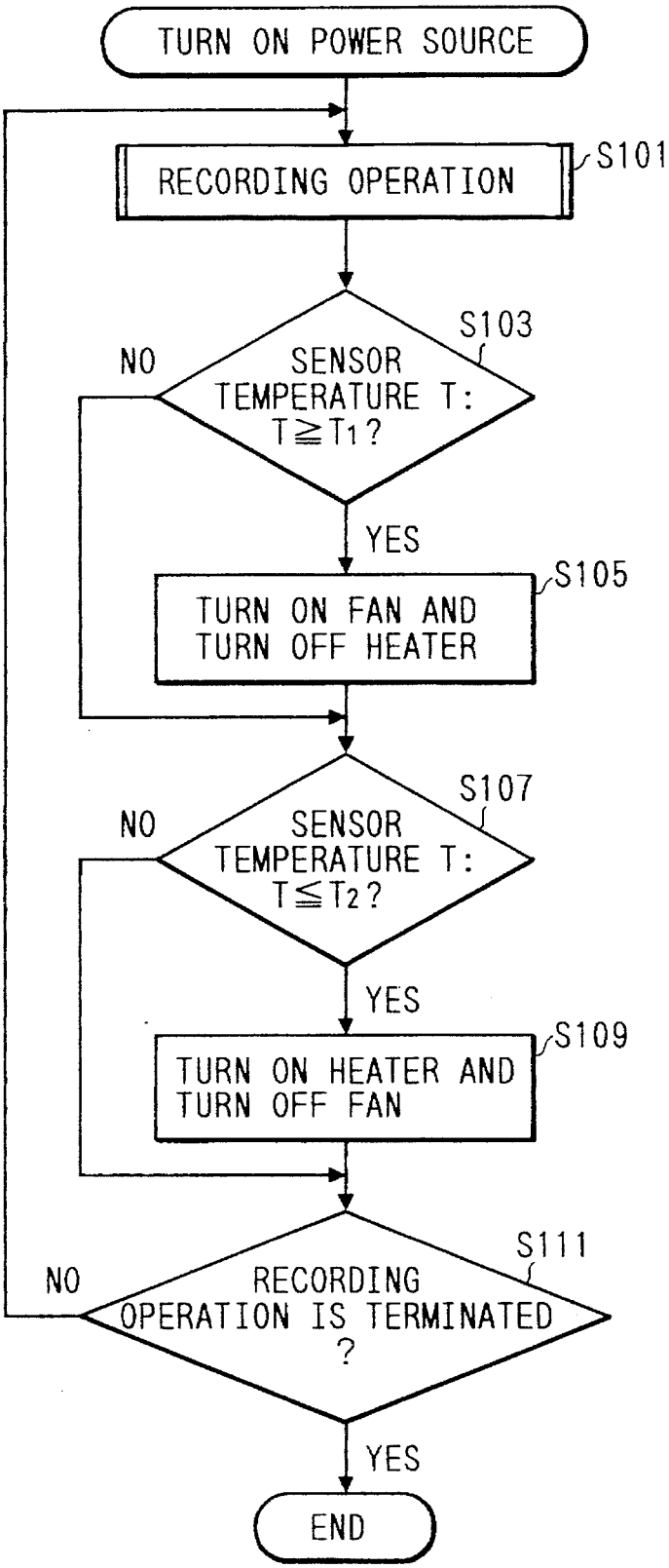
FIGS. 14A–14C are flowcharts showing the processing procedure for temperature control of a recording head, according to an example of the present invention.
Figures 1, 14B:
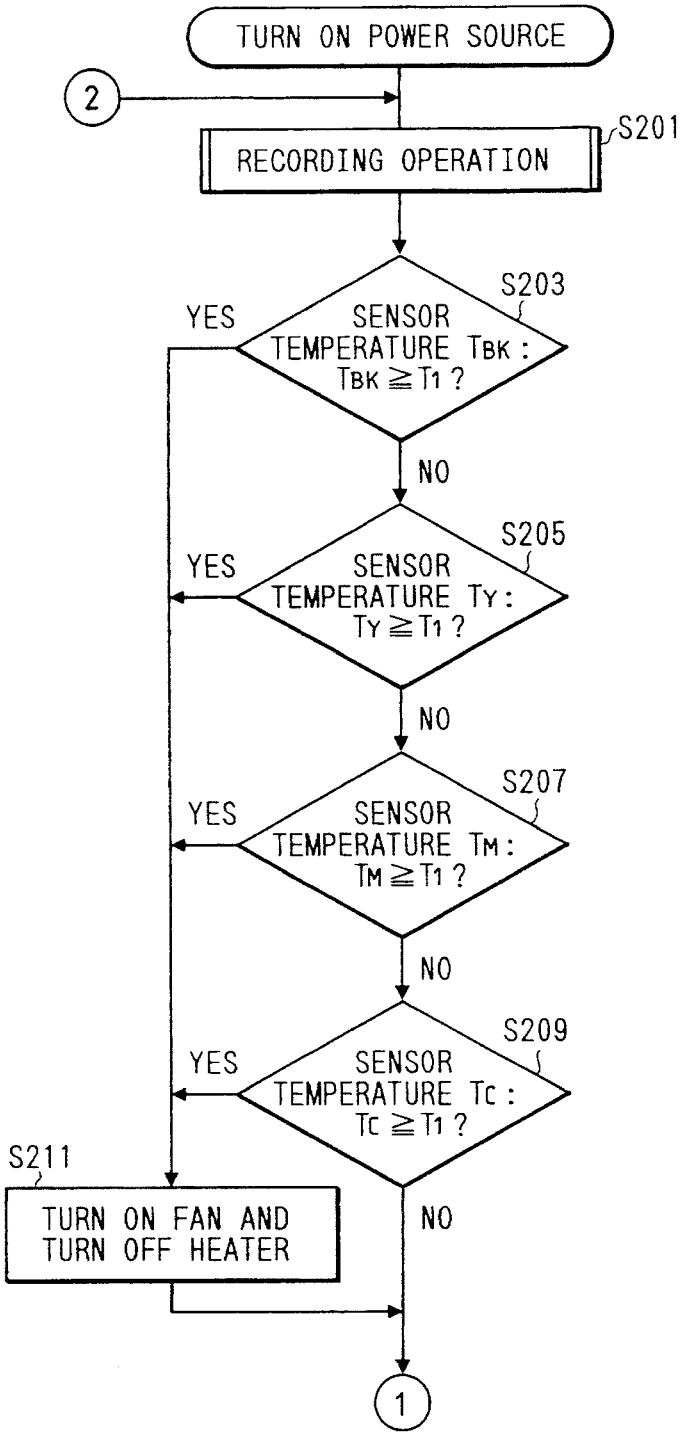

FIGS. 2A–2C are views showing an example of a recording head unit having a recording head 1 constituting the recording unit of the ink jet recording apparatus as shown in FIG. 1, and a heat pipe 2 as heat exchange means, i.e., FIG. 2A is a schematic perspective view showing only one of the four heads, FIGS. 2B and 2C are a schematic plan view and a schematic side view showing the whole of the recording head unit.

In these figures, 1 is a so-called full-line type recording head provided with discharge ports, corresponding to almost the entire width of the recording area on a recording medium. The recording head of the present invention has 4736 discharge ports arranged at a pitch of 63.5 μm. An electricity-heat converter is provided in each liquid channel communicating to each of the discharge ports. The ink is discharged using the pressure changes caused by the generation of bubbles due to film boiling, which is caused by using the heat energy generated by the electricity-heat converters and producing rapid temperature elevation in the ink in the neighborhood thereof.

2 is a heat pipe provided in contact with almost the entire area except for a predetermined area of one side face in the longitudinal direction for each recording head 1. Each of the heat pipes 2 is formed with a near square portion 2A in the area not in contact with the recording head 1 at one end portion thereof, in which each of extreme ends of the portion 2A is integrally formed for the mutual communication thereof. Of course, the shape of the portion 2A or the form of mutual communication is not limited to the above mentioned one, but all the forms practicable with the present invention are included. An arrangement especially for the temperature control of each heat pipe, can be made simpler, owing to such an integral formation. Between the portions 2 are attached serpentine-shaped fins 3. Thereby, a first heat exchange unit 20A for exchanging the heat between heat pipe 2 and recording head 1, and a second heat exchange unit 20B extending away from the outside of the recording area of the recording head are constituted.

The heat pipe 2, 2A is constructed of a body made of aluminum, in view of the processibility and cost as well as the heat transfer ability, and the working fluid injected into its hollow interior. The heat pipe is generally needed to take into consideration the amount of heat transport. That is, since the amount of heat transfer for the heat pipe is limited, it is requisite for an appropriate heat characteristic for recording that the quantity of heat exceeding the maximum quantity of heat transferred from the head to the heat pipe or from the heat pipe to the head is transferable.

A critical value for the amount of heat transport as above described is correlated to the sectional area of the heat pipe, such that the larger the sectional area of the heat pipe, the greater the amount of heat transport.

On the other hand, for color image recording using a plurality of recording heads, like the present example, as the distance between recording heads in the conveyance direction of a recording sheet increases, the memory for storing image data transferred may be increased, thereby bringing about an increased cost of the whole apparatus.

The distance between recording heads is preferably smaller because it improves the precision for the relative positional alignment (thereafter referred to as registration) between the recording head and a recording sheet, and the recording apparatus can be miniaturized.

The heat pipe for use in this example is constructed, in view of those respects, in such a way that the heat pipe 2 constituting a first heat exchange unit 20A for exchanging the heat owing to the heat transfer with the recording head 1 has formed a near rectangular cross section, and the heat pipe 2A constituting a second heat exchange unit 20B mainly for radiating the heat is shaped like a near square having the same thickness as that of the heat pipe 2 as above described. The use of the heat pipe so shaped can render the distance between recording heads smaller, and so efficient heat exchange is enabled without reducing the amount of heat transport. Also, with the shape as previously described, a contact area with the recording head can be increased, so that the heat transfer efficiency can be further improved.

The recording head 1 and the heat pipe 2 are connected by means of a pressure welding member 8. That is, the pressure welding member, which is a member like a leaf spring, connects those two portions by biasing the heat pipe 2 into contact with almost the entire area except for a predetermined area of one side face in the longitudinal direction for the recording head 1, as shown in FIG. 6. Also, this pressure welding member 8 is provided with several slits in the longitudinal direction, as previously described. The slits are intended to weld the heat pipe to the head 1 with a uniform biasing force, whereby the heat transfer between the head 1 and the heat pipe 2 can be achieved evenly over the recording head, while allowing a smoother detachment of the heat pipe at the insertion thereof.

The pressure welding member is appropriately made of a material with the elasticity such as SUS or phosphor bronze, with the thickness being optimally between 0.2 mm and 1.0 mm. As its thickness is very small, a thermal problem such as the heat transfer can be ignored irrespective of a direct contact with the heat pipe 2.

In a portion of the heat pipe 2A constituting the second heat exchange unit 20B, the heat radiation fins 3 constituting heat radiation means as previously described are attached in such a manner of being forced into three area formed between four heat pipes 2A. In order to exhibit the heat radiation feature of the heat radiation fins 3 at maximum, a fan 4 constituting heat radiation means is provided near and below the heat radiation fins 3 to send the air in the direction opposite to the direction where the ink is discharged from the recording head. The maximum air speed of the fan 4 is 3 m/sec, and an air blast port 4A, a part of which is shown in FIG. 2A, extends over three area where the fins 3 are provided.

The fan 4 is not limited to the attachment form of this example, but can be disposed in the most preferable position where the heat radiation auxiliary effects and miniaturization of the apparatus can be accomplished, without ink mist problem or the influence of ink discharge direction as will be described later. As can be clearly seen from FIGS. 2B and 2C, the heat pipe 2, 2A and the recording head 1 are supported by a housing 101, whereas the second heat exchange unit, i.e., a portion where the heat pipe 2A and the fins 3 are disposed, has no supported member such as the housing. Thereby, there is no obstacle against the air blast or air flow generated by the fan 4, and the air can be suitably sent to the fins 3 and the heat pipe 2A.

Note that the fan 4 is provided in the main apparatus, but may be provided in the recording unit such as the recording head. And the heat radiation fins 3 are provided in such a manner of forming their faces crosswise in the longitudinal direction of heat pipe 2. By providing the heat radiation fins 3 in the above manner, the heat exchange ability can be secured, and the wind blowing from below the heat radiation fins 3 by the fan 4 is prevented from passing to the recording head (recording area). Thereby, the problems of ink mist flying around within the recording apparatus, and unintentional change in ink discharge direction, can be avoided. The heat radiation fins 3 use aluminum which is light and relatively excellent in heat radiation ability, like the heat pipe 2.

Referring again to FIGS. 2A–2C, 5 is a temperature sensor composable of a thermistor, for example, which is provided in a central portion of an area where four heat pipes are integrated in the second heat exchange unit. 6 is a heater which is a face-like heater, mounted on each of side faces of the heat pipes 2A disposed most outwardly among four heat pipes 2A.

The temperature sensor for use in this example is a PCB-type thermistor in small ball shape, with $\phi$ 1.5 mm (a diameter of contact face with heat pipe) x 2.5 mm (thickness of sensor). Like this example, when the heat pipe 2, 2A is a so-called integrated heat pipe in which a plurality of heat pipes are communicate at end portions to use the working fluid commonly, a single temperature sensor 5 enables the temperature of four recording heads 1 to be detected, in which its attachment position is a central portion of a connection area where heat pipes 2A are integrated.

Generally, the temperature sensor is provided to sense the temperature of recording head which is varied along with the recording in the temperature control of recording head, and essentially, it is sometimes desirable that it is directly attached to the recording head to sense the temperature with high response.

However, the ink jet recording apparatus of this example is constructed to be capable of exchanging recording heads separately, as required, owing to the degradation in discharge characteristic of recording heads for use therewith. Accordingly, when the temperature sensor is mounted on the recording head, a problem may arise such that the operation for detaching the temperature sensor from the recording head is complicated, or if the whole unit of the recording head is exchanged together with the temperature sensor, the temperature sensor brings about a higher cost.

Also, when the temperature sensor is directly mounted, the temperature of a portion, except for the portion where the temperature sensor is mounted on the recording head, can not be reflected with high response, because some materials constituting the recording head may have small thermal conductivities. Particularly, in the full-line type recording head, like in this example, it is remarkable.

From the reasons as above described, when the temperature sensor is provided on the heat pipe, the sensing of temperature can be accomplished with high response corresponding to a temperature distribution developed on the recording head, due to a rapid temperature equalizing action with the excellent thermal conductivity of the heat pipe.

Note that in this example, only one temperature sensor 5 is provided in an integrated connection region of heat pipe 2A, but it is effective in a recording apparatus correspondent to a recording mode in which the temperature of each head can be sufficiently equalized because of the heat pipe integrated therewith, and the temperature dispersions between four recording heads are relatively small. However, in a detachable recording head, like in this example, temperature differences between heads may occur because the thermal resistance to the heat pipe sometimes becomes large. In this way, when the temperature dispersions between heads are large, it is desirable that the temperature sensor is provided corresponding to each of four recording heads in order to make the appropriate temperature control for each recording head. In this case, the mounting position of the temperature sensor is preferably at a central portion of each heat pipe 2.

On the other hand, the heater 6 is attached on each side face of two heat pipes 2A disposed most outwardly, as above described.

The heat pipe used together with the heater is provided to transfer the heat generated by the heater uniformly over the entire area of the recording head, using an excellent thermal conductivity of the heat pipe. Thus, the position for attaching the heater on the heat pipe is desirably one where at least a part of the heater corresponds to a portion corresponding to the working fluid within the heat pipe. Thereby, the heat generated by the heater can be transferred rapidly to the working fluid, which then evaporates with that heat, so that the vapor generated enables the rapid heat transport over the entire area of the recording head. By the way, as will be detailed in FIG. 3, in a state where a unit of the recording head and the heat pipe is mounted in the ink jet recording apparatus of this example, i.e., during the non-recording, the heat pipe is oriented in the horizontal direction where the recording head 1 and the heat pipe 2 extend, as shown in FIG. 2C. Therefore, the working fluid exists in a lower portion of the heat pipe 2, 2A during the recording in the situation as shown in FIG. 2C. From the above respects, in this example, the face-like heater 6 is attached overlaying a portion corresponding to the working fluid within heat pipe 2.

When the heater is attached to any portion on the heat pipe 2 corresponding to the recording head 1, the heat generated by the heater is transferred to the recording head in the neighborhood thereof, without passing through the heat pipe 2, whereby it is apprehended that adverse effects may occur, such as raising the temperature. Also in this meaning, the heater 6 is desirably disposed on the heat pipe 2A away from the recording head 1.

The heater 6 is a near square, face-like heater, as previously described. This is intended to prevent the heat generated by the heater from being concentrated in a part of the heat pipe, thereby causing the dry out phenomenon. That is, it is intended that the heat should be generated by the heater on wide area, rather than a limited area. Also, the heater 6 has a power of 100 W to raise the temperature of the recording head above about 40° C. and rapidly, when the atmosphere temperature used for the apparatus of this example is low.

Note that in this example, the heater 6 is joined directly to the body of heat pipe 2A, whereas when a generally available heater is used, the heater may be attached via a plate made of aluminum or the like in accordance with the power of the heater, or the quantity of heat transferred to the heat pipe can be controlled by providing some apertures in the plate. Moreover, when the power of heater to be used is relatively large, a single heater can be used and may be provided on connection portion of the heat pipe 2A. In this case, the sensor 5 similarly provided on the connection portion should be attached upward a little away from the heater (as shown in FIG. 2C).

The heater 6 is not limited to a face-like heater, but may be a power transistor, for example. In this case, as the power transistor is small, with a relatively large amount of heat generation, it should be mounted via a predetermined member, in view of the dry out phenomenon as above described.

As can be clearly understood from the above description, with the constitution of heat pipe according to this example, the number of heaters or temperature sensors can be reduced, so that it is possible to decrease the cost in the constitution for the temperature control of recording head.

In FIGS. 2B and 2C, members as indicated by 22, 23, 24*a*, 24*b* and 25 are those for the adjustment of registration, while members as indicated by 30–33 are those for the adjustment of warpage in the recording head. The constitution and operation for them will be described later with reference to FIGS. 2B and 2C, FIGS. 11A and 11B, and FIGS. 12A to 12C.

Figure 3C:
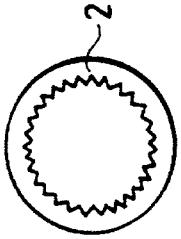
FIG. 3C PRIOR ART
FIG. 3C is a lateral cross-sectional view of a conventional heat pipe.
Figure 3D:
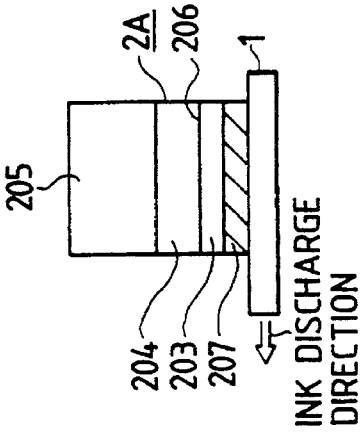
FIG. 3D is another perspective view of the example of the present invention as depicted in FIG. 3B.
Figure 3A:
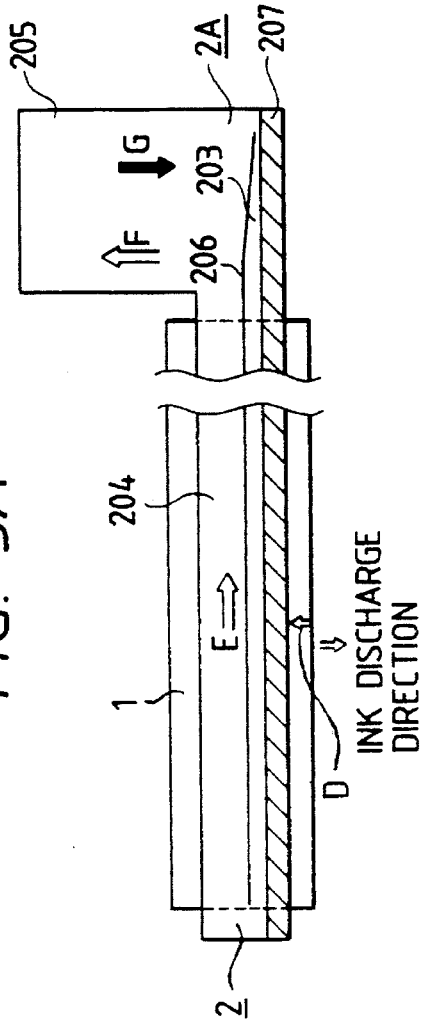
FIGS. 3A and 3B are schematic cross-sectional views showing an internal constitution of a heat pipe according to an example of the present invention.

FIG. 3A is a schematic cross-sectional view showing the internal constitution for the heat pipe 2, 2A. In FIG. 3A, 203 is a working fluid filled portion which is filled with the working fluid 207, and 206 is a partition plate provided upwardly of the working fluid filled portion 203 and covering almost the entire area of working fluid filled portion 203 except for its both end portions. 204 is a working fluid vapor passage provided on a portion corresponding to the heat pipe 2 and formed upwardly of the partition plate 206, and 205 is a heat radiation portion (condensation portion) provided on a portion corresponding to the heat pipe 2A and formed upwardly of the partition plate 206.

The heat pipe 2, 2A as above described is used and connected with the recording head 1, as will be detailed later. In recording with such recording head 1, the heat generated by the electricity-heat converters provided corresponding to the ink discharge ports is first passed into the working fluid filled portion 203 (direction as indicated by an arrow D in the figure). This heat is rapidly diffused almost over the entire area of working fluid filled portion 203, along with the convection and evaporation of working fluid 207, so that the interior of working fluid filled portion 203 is rendered uniform in temperature. This equalizing of temperature for the filled portion 203 causes the ink temperature in the vicinity of the areas where the electricity-heat converters of recording head 1 are disposed, i.e., the temperature of recording head, to be equalized.

The vapor occurring in the working fluid filled portion 203 passes through a portion not provided with the partition plate 206 at an end portion of the filled portion 203 to the vapor passage 204, and passes through the vapor passage 204 (direction as indicated by an arrow E in the figure) to the heat radiation unit 205, further moving in the direction as indicated by an arrow F in the figure. During this movement, the vapor condenses due to heat loss. Such condensed working fluid 207 moves along inner walls constituting the heat pipe 2A in the arrow D direction (gravity direction) and returns to the working fluid filled portion 203.

In the operation of the working fluid as shown in the figure, the temperature equalizing action for the recording head with the working fluid can be accomplished independently of the condensation of the working fluid, because of the partition plate 206 provided therein. That is, the heat generated with dispersed temperature distribution between discharge ports in the recording head 1, or the heat generated from the heaters 6 attached to side faces of heat pipe 2A, is rapidly equalized in temperature in the working fluid filled portion 203, and as a result, the uniform temperature can be achieved among discharge ports of recording head 1, in which the behavior of the heat in the heat radiation unit 205 is not transmitted to the working fluid filled portion 203 because of the partition plate 206. Thereby, the efficient temperature equalizing and heat radiation actions are enabled with the heat pipe. Also, with the existence of partition plate 206, the circulation of heat from the generation of excess heat in the working fluid filled portion 203 to the condensation of heat in the heat radiation unit 205 can be effectively accomplished.

Further, the partition plate can prevent the working fluid from being wiped away due to the movement of vapor, and thereby can prevent the temperature elevation of the recording head with the dry out phenomenon.

In order to perform a series of operations using the working fluid as above described smoothly, it is preferred that the heat radiation unit 205, the vapor passage 204 and the working fluid filled portion 203 are arranged in sequence along the gravitational direction G.

With the above arrangement of heat pipe 2, 2A, more efficient equalization and radiation of temperature for the recording head can be accomplished, compared with a conventional cylindrical heat pipe as shown in FIG. 3, and a simple heat pipe can be obtained. That is, FIG. 3C shows a lateral cross section of a conventional heat pipe, which heat pipe is provided with grooves for moving the working fluid adhering to the inner walls of the heat pipe with the condensation, to a portion of the heat pipe corresponding to the recording head owing to the capillary action. Therefore, a process of forming grooves on the inner walls of heat pipe is necessary, thereby possibly bringing about the increase of cost. Also, this conventional heat pipe is not sufficient for the efficient temperature equalization action to be achieved due to the lack of a partition plate.

Note that the function of partition plate 206 is not only that of efficiently enabling the temperature equalization action and the heat radiation action independently, but also that of preventing the working fluid from unevenly distributing within the heat pipe 2, 2A, during the movement of the recording head 1 for the capping, as will be described later in FIG. 13, for example. Thereby, the temperature equalization and the heat radiation can be effectively accomplished even during the capping operation. When the recording head for use is a so-called serial-type recording head which performs the recording along with the scanning movement, the function of the partition plate is especially remarkably exhibited.

Figure 3B:
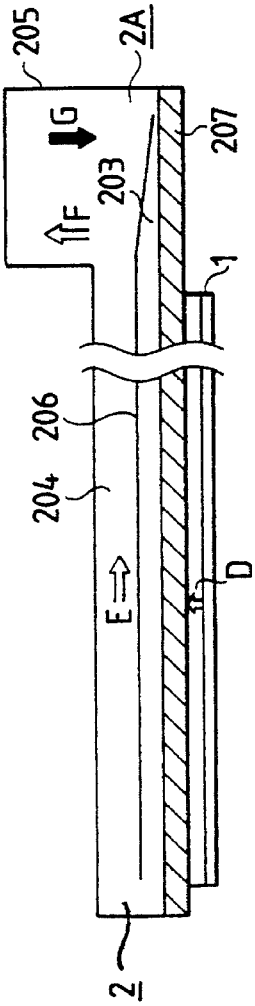

FIGS. 3B and 3D show an example in which the ink discharge direction is a normal direction (horizontal direction) with respect to the gravitational direction. In this case, with the constitution of arranging the heat radiation unit 205, the vapor passage 204, the working fluid filled portion 203 and the heating unit of recording head 1 in this sequence along the gravitational direction, the temperature equalization and heat radiation actions can be exhibited in the same way as those for the example shown in FIG. 3A. In this constitution, it is desirable for the recording characteristic to shift the heating unit existing in and near the discharge port face to the horizontal direction, as shown in FIG. 3B. This will be described in detail in connection with FIG. 6.

Figure 4:
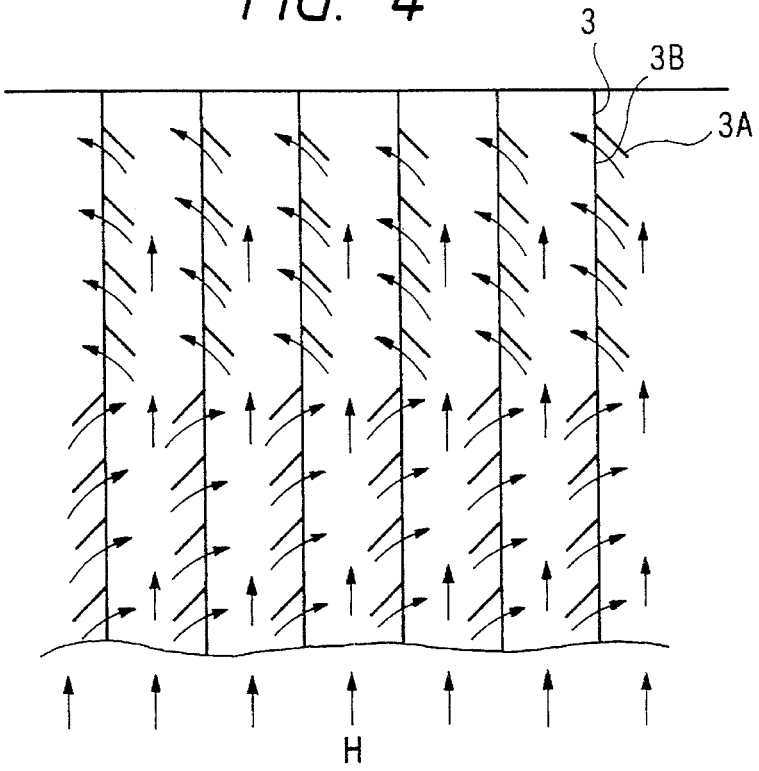
FIG. 4 is a schematic cross-sectional view showing the detail shape of fins according to an example of the present invention.
Figures 2, 14B:
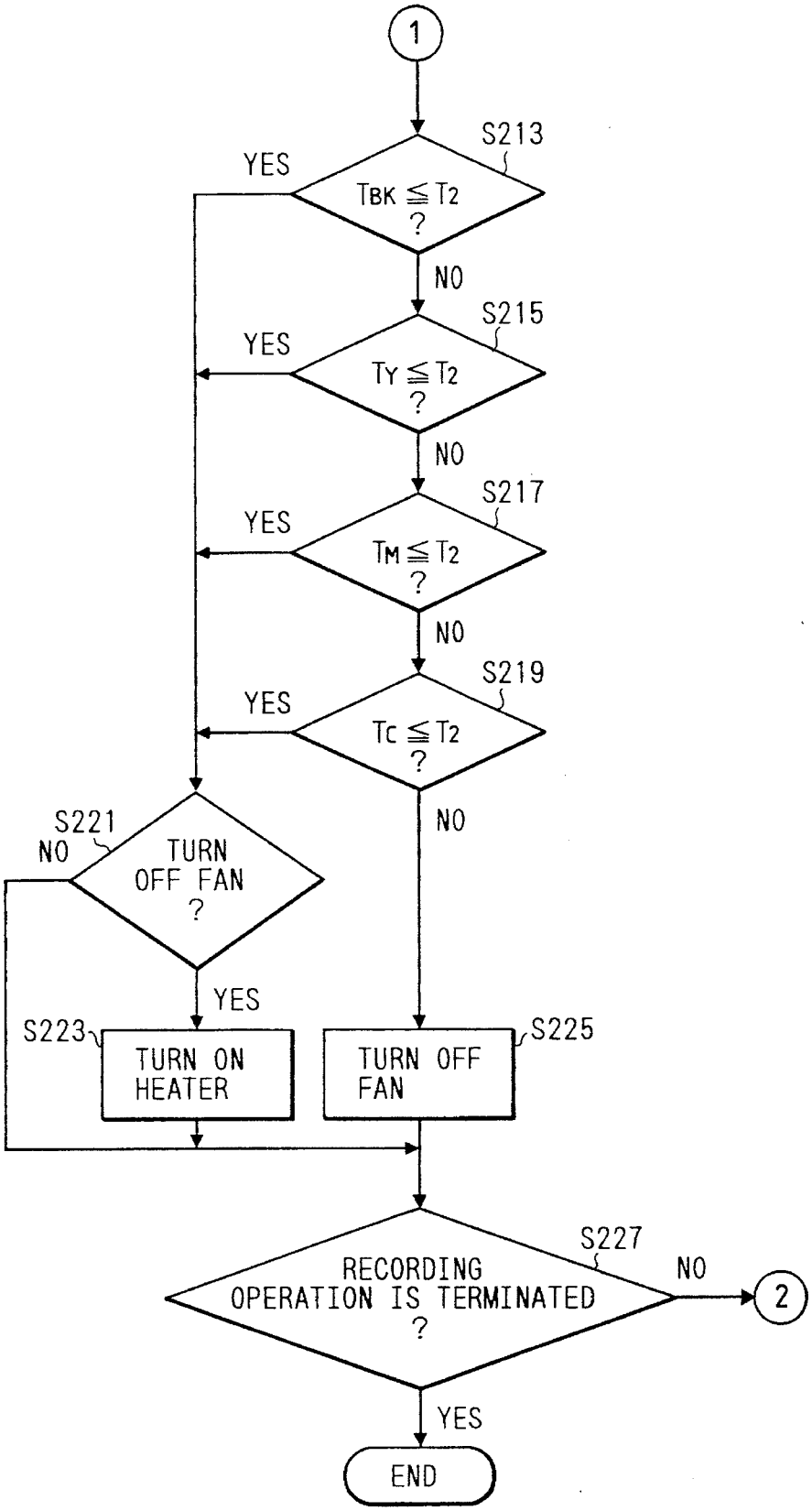

FIG. 4 is a typical cross-sectional view, showing the detail of fins 3 as shown in FIG. 2, from the direction as indicated by an arrow B in FIG. 2B. FIG. 4 shows only a part of fins 3.

As clearly seen from FIG. 4, the fins 3 are provided with a plurality of slit plates 3A formed with slits 3B opening right or left downward alternately in predetermined regions. With this arrangement of the fins 3, the flow of air sent by the fan 4, from below as indicated by an arrow H in the figure passes into the fins 3, in which a part of air flow is deflected by the slit plates 3A depending on the opening direction of the slit, as indicated by arrows in the figure. Thereby, the air flow passing between a plurality of fins 3 is made turbulent. This turbulent flow state can relatively effectively cause the heat of fins 3 to transfer to the air flow, and make it difficult for the air flow from the fins 3 to break away, so that the heat radiation effect can be improved.

Furthermore, with the slit plates 3A provided, the surface area for the heat radiation over the entire fins 3 can be increased, thereby improving the efficiency of heat radiation.

The fins 3 according to this example are disposed in three spaces formed between four heat pipes 2A, and shaped like serpentine in respective spaces. With the above arrangement, the effects of heat radiation are not lost with the provisions of the slit plates with serpentine-like slits as above described, even by making smaller the space for disposing the second heat exchange unit as well as making the heat pipe 2A plate-shaped.

Note that the heat pipe and the shape of the fins are not limited to those of this example, but may be those as shown in FIG. 16, for example, in accordance with the amount of required heat radiation or blasting air from the fan. Also in this case, the efficiency of heat radiation can be increased by the provision of the slit plates having slits on the fan 3.

The directions in which the slit plates open and the number of slit plates for each region are of course not limited, but the directions in which the slit plates open may be changed alternately one by one.

Figure 5:
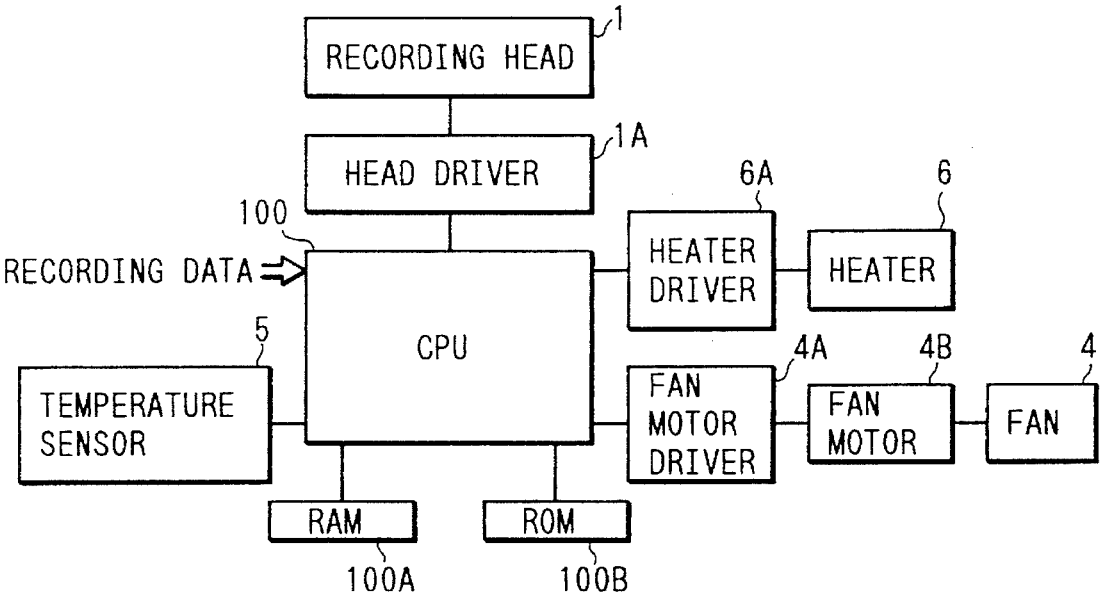
FIG. 5 is a block diagram showing a control configuration of an ink jet recording apparatus according to an example of the present invention.

FIG. 5 is a block diagram showing a control configuration of recording unit 302 using an ink jet recording apparatus of this example. In this figure, the control configuration for a conveyance system for a recording medium is omitted, and the control configuration for the temperature adjustment of recording head 1 is mainly shown.

In FIG. 5, 100 is a CPU for executing the operations in the recording unit 302 using the ink jet recording apparatus of this example, and the control operations for the data processing. 100A is a RAM useful as the work area in the control operation with the CPU 100, and 100B is a ROM for storing the processing procedures in connection with the recording unit 302, such as a processing procedure as will be described later in FIG. 14. 1A is a head driver for driving the electricity-heat converters of recording head 1 based on a drive data signal and a control signal transferred from the CPU 100, and 4A and 6A are a fan motor driver and a heater driver for driving a fan motor 4B for rotation of fan 4 and a heater 6 based on a control signal from the CPU 100, respectively.

The CPU 100 performs a predetermined processing for recording data transferred from the scanner unit 301, and then transfers them to the head driver 1A as driving data, in synchronization with the conveyance of recording sheet. And at the same time, the CPU 100 controls the temperature of the recording head using the fan 4 and the heater 6, as will be described later in FIG. 14, based on the temperature of the recording head 1 sensed by the temperature sensor.

Figure 6A:
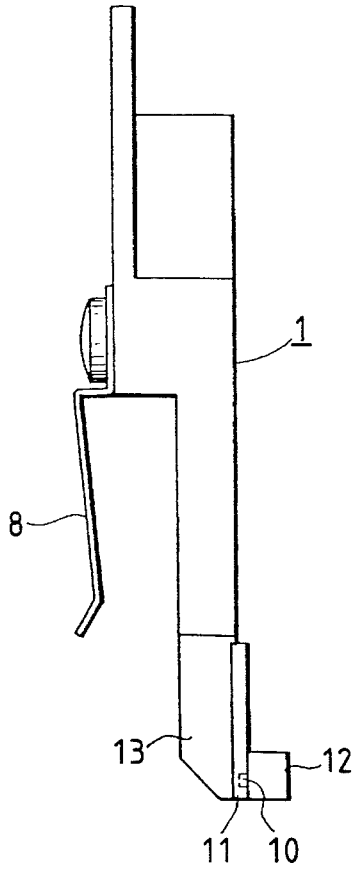
FIGS. 6A and 6B are schematic cross-sectional views showing the attachment state of a heat pipe to a recording head, according to an example of the present invention.
Figure 6B:
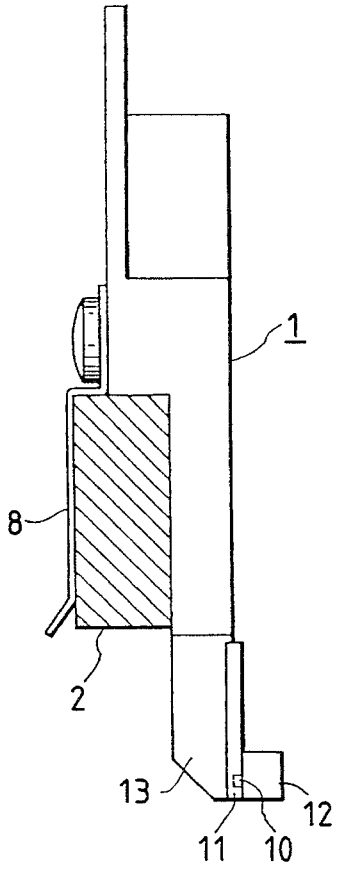

FIGS. 6A and 6B are side views of recording head 1 and heat pipe 2, 2A showing the detail of recording head 1 and the attachment form of heat pipe 2, 2A, respectively.

In these figures, 10 is an electricity-heat converter for generating the heat energy used for discharging the ink, in which 4376 electricity-heat converters are arranged at a density of 400 dpi in the perpendicular direction to the figure, with a discharge port (not shown) provided corresponding to each of them. 11 is a substrate on which the electricity-heat converters 10 are disposed, and 12 is a ceiling plate for forming a liquid channel communicating to a discharge port, in which an electricity-heat converter 10 is disposed, and a common liquid chamber for supplying the ink to the liquid channel, by the connection to the substrate 11. 13 is a base body for supporting the substrate 11, which constitutes a main body.

In the above arrangement, the heat pipe 2 is attached to a side area of base body 13 supporting the substrate 11 on which the electricity-heat converters are provided, and which area does not correspond to a portion where the electricity-heat converters are provided, as shown in FIG. 6B. That is, the heat pipe is not attached to an area for disposing the electricity-heat converters where the substrate 11 and the base body 13 are interposed in the direction of its thickness.

When the heat pipe is provided in an area corresponding to the electricity-heat converters, the temperature or discharge of ink in the vicinity of electricity-heat converters is easily affected. That is, for example, when the heat pipe is not provided in the vicinity of electricity-heat converters, about 40% to 60% of the quantity of heat generated by the electricity-heat converters is used as the energy for discharging the ink, while when the heat pipe is provided in the vicinity of the electricity-heat converters, only a part of the heat energy, e.g., about 10%, is involved in discharging the ink, because the large amount of heat is transferred between the heat pipe and the vicinity of the electricity-heat converters. If excellent ink discharge is desired under such conditions, the voltage or pulse width of driving pulse, for example, must be larger in order to increase the heat energy generated by the electricity-heat converters, so that the consumption power increases. Also, if the heat energy generated is increased, the speed of heat transfer for equalizing the temperature of the recording head must be made higher, thereby bringing about the complexity of constitution.

Also, if the amount of heat transfer between the heat pipe and the vicinity of electricity-heat converters becomes larger, the heat from heat pipe is liable to move into the vicinity of converters, thereby raising the ink temperature on that portion higher than necessary, so that more than a desired amount of ink may be discharged to affect the density of image to be recorded.

As described, the ink discharge characteristic and the temperature control can be excellently accomplished for the recording head using the heat pipe in such a manner that the excess amount of heat transfer is avoided from or into the vicinity of electricity-heat converters by providing the heat pipe in contact with an area off the region where the electricity-heat converters of recording head are provided.

In addition, with the arrangement of the heat pipe as above described, the temperature in the ink liquid channels or within the common liquid chamber can be controlled more easily than that in the vicinity of the electricity-heat converters for the recording head. Thus, the stable ink viscosity can be achieved all over the recording head of full-line type in particular, and the responsibility of ink behavior such as ink refill can be stabilized.

Figure 7A:
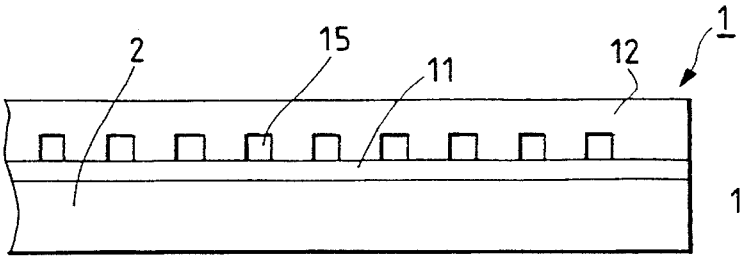
FIGS. 7A and 7B are a front view and a side cross-sectional view showing the attachment state of a heat pipe as shown in FIG. 6, according to another example of the present invention.
Figure 7B:
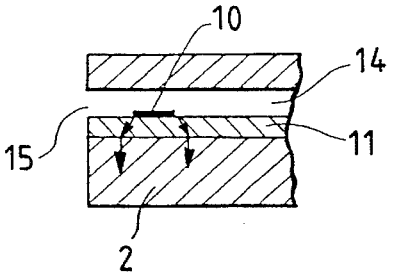

FIGS. 7A and 7B are a typical front view and a typical side view showing a second example for the constitution as shown in FIGS. 6A and 6B.

In FIGS. 7A and 7B, 1 is an ink jet recording head of this example, 11 is a substrate for recording head 1, and 2 is a heat pipe disposed along the substrate 11, where electricity-heat converters 10, liquid channels 14 and discharge ports 15 are formed. 16 is a ceiling plate for forming the liquid channels 14 and the discharge ports 15.

Now, when the substrate 11 for the recording head 1 as above described is formed of a silicon plate with a thickness of 1 mm, with the application of driving pulses of 33 (V) and a pulse width of 7 (μs) to the electricity-heat converters, the heat generated by the converters 10 will gradually diffuse through the substrate 11 to the heat pipe 2, as indicated by an arrow in FIG. 7B. In this case, air flow of 2 m/s with a heater of output 50 W and a fan allowed the temperature of recording head 1 to be stably maintained with a range from 45° C. to 52° C. at all times. On the other hand, when the substrate 11 is formed of a silicon substrate having a thickness of 0.4 mm, the ink could not be discharged with the application of the same driving pulses.

The experimental results as above can be explained as follows. That is, if the thickness of silicon substrate is reduced, the heat will pass more easily through the substrate 11 to the heat pipe 2, whereby the quantity of heat transferred is increased and thus, the quantity of heat transferred to the ink contact with the electricity-heat converters 10 within the liquid channels 14 will be reduced. Accordingly, when the substrate 11 is formed of a silicon substrate having a thickness below 0.5 mm, the heat energy necessary for ink bubbles can not be obtained from the electricity-heat converters 10, so that a stable discharge may not be achieved. In practice, the measurement of ratio for the quantity of heat transferred to the heat pipe 2 in the experiment as above described showed that about 70% of making power to the electricity-heat converters 10 when the thickness of silicon substrate was 1 mm, and about 80% of making power when the thickness of silicon substrate was 0.5 mm, would transfer to the heat pipe 2 as the conversion heat, and it has been found from the above experiment that the quantity of heat transferred by diffusion to the heat pipe 2 is desirably up to about 70%.

Figure 8A:
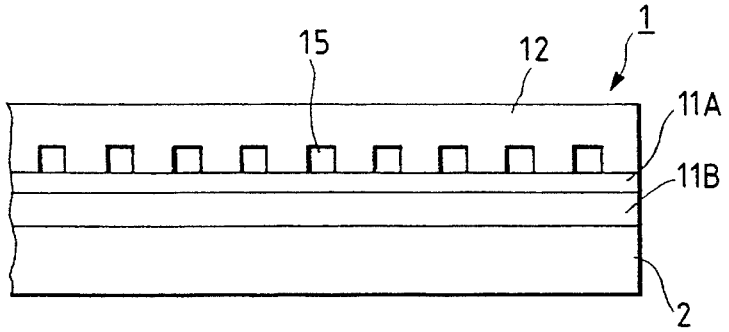
FIGS. 8A and 8B are a front view and a side cross-sectional view showing the attachment state of a heat pipe as shown in FIG. 6, according to a further example of the present invention.
Figure 8B:
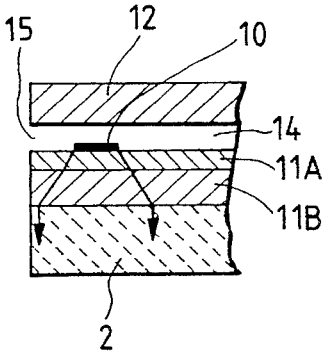

FIGS. 8A and 8B show a recording head and a heat pipe according to a third example. The recording head 1 of this example comprises a first substrate 11A such as a silicon substrate where the electricity-heat converters 10 are provided, and a second substrate 11B made of aluminum or copper with an excellent thermal conductivity, wherein the heat flux from the recording head 1 diffuses as indicated by an arrow in FIG. 8B so that the concentration of heat is avoided, and accordingly, the ability of heat transfer with the heat pipe 2 can be prevented from being excessive.

As an experiment using the third example, where the first substrate 11A is the same as that for the first example, and the second substrate 11B is an aluminum substrate having a thickness of 5 mm, the supply of low energy driving pulses of 30(V) with a pulse width of 7 μm gave an excellent ink discharge characteristic. Note that in this experiment, using the heat pipe 2 having the maximum heat transport ability of 70 (W), the recording head 1 can be controlled within a range from 45° C. to 52° C. at all times. However, if the thickness of the second substrate 11B is above 10 mm, the heat transfer becomes too small to control the recording head 1 within a range from 45° C. to 52° C.

Figure 9A:
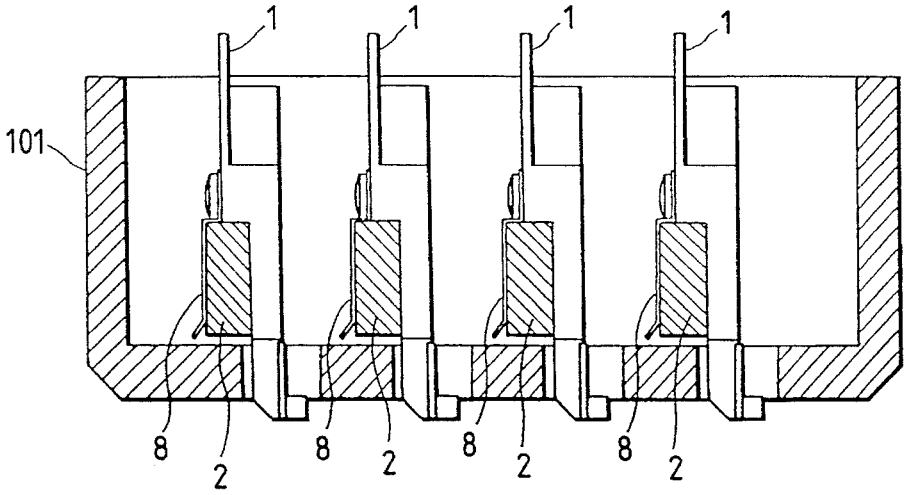
FIGS. 9A and 9B are a cross-sectional view and a perspective view showing the attachment and detachment states of a heat pipe to and from a recording head, respectively, according to an example of the present invention.
Figure 9B:
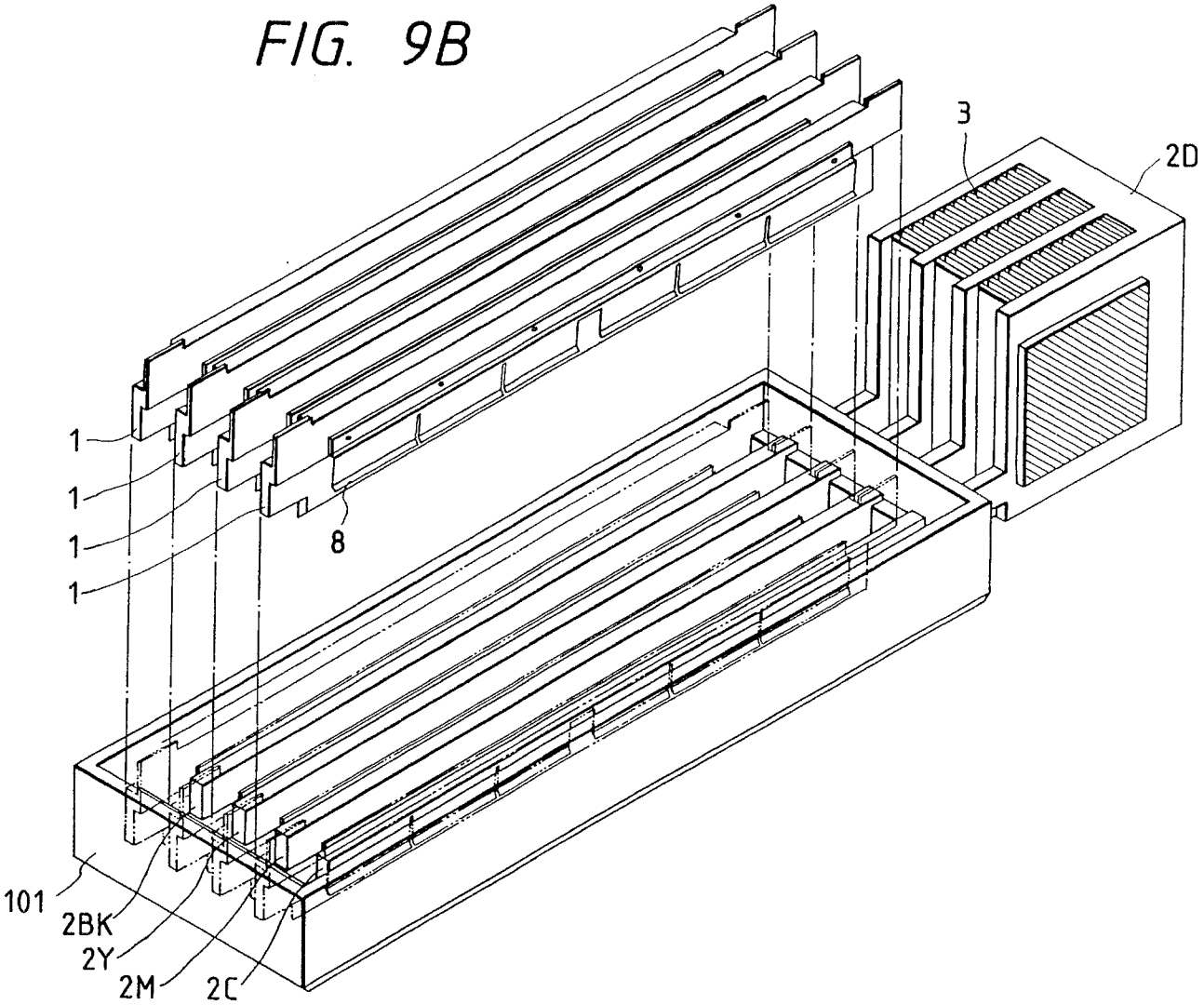

FIGS. 9A and 9B are views for explaining the arrangement for the attachment and detachment of the recording head, and specifically, FIG. 9A is a cross-sectional view showing a state where four recording heads 1 are attached, looked from the side, and FIG. 9B is a perspective view showing a state where the recording heads are attached.

In FIG. 9A, the heat pipe 2, 2A is secured to the housing 101 near a boundary between the heat pipe 2 and the heat pipe 2A, i.e., between first heat exchange unit and second heat exchange unit, in which the recording head comprising biasing members 8 is attached to the heat pipe 2 from the upperpart in the same figure. The recording head 1 has the biasing member 8 slightly inclined toward the recording head 1 before its attachment as shown in FIG. 6A. In attaching the recording head, the heat pipe 2 is inserted into a space between the biasing member 8 and the recording head 1, wherein the heat pipe 2 is relatively biased toward the recording head 1 with an elastic force developed by the biasing member.

FIG. 9B shows a state before the recording head 1 is inserted into the housing 101, or after it is detached. In this way, as the recording head can be detached for each ink color, the exchange of recording heads can be made easier.

Figure 10:
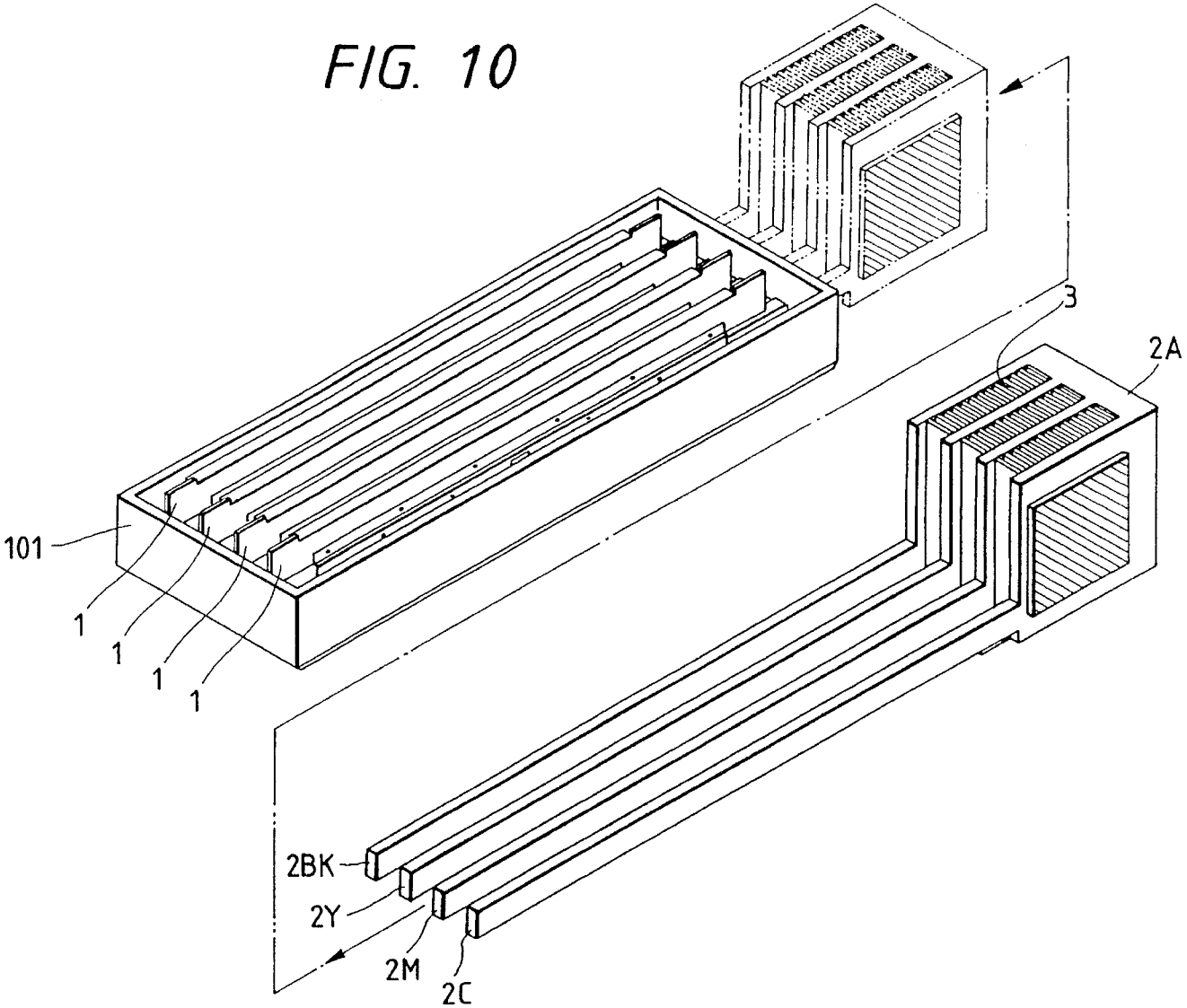
FIG. 10 is a perspective view showing the attachment and detachment states of a heat pipe to and from a recording head, according to another example of the present invention.

FIG. 10 shows a state where the recording head is secured to the housing 101, and four heat pipes 2, 2A are detached integrally, contrary to that as shown in FIG. 9. In this constitution, the direction of inserting the heat pipes 2, 2A is a longitudinal direction of recording head, as shown in the same figure, and each heat pipe 2 is inserted between biasing member 8 and recording head 1.

As above described, for the attachment or detachment of recording head as shown in FIGS. 9 and 10, the recording head 1 and the heat pipe 2 are secured to each other by means of the biasing member 8, while at the same time the positioning of recording head 1 in the recording sheet conveyance direction, or the direction perpendicular to the longitudinal direction of recording head 1, can be accurately controlled.

Next, the positioning of the recording head in the ink jet recording apparatus with the above constitution, and the registration feature between heads and its operation will be described with reference to FIGS. 2B and 2C.

In these figures, 101 is a housing for holding the heat pipe 2 attached along a side face of recording head 11 as well as a plurality of recording heads 1, and 101A and 101B are positioning surfaces for positioning in the direction as indicated by an arrow C with which both end portions of each recording head 1 on the hand of discharge port face 1A are brought into contact. One of these positioning surfaces, i.e., the positioning surface 101B on the hand where the heat pipe 2 is restricted by a housing wall 101C, is provided with a head positioning pin 25 projecting therefrom, wherein the position of recording head 1 on this end portion is restrained by the pin 25 fitting into a long hole 1B extending in the direction as indicated by an arrow A and provided on the recording head 1.

22 is a presser bar spring for restraining the position of recording head 1 in the directions as indicated by an arrow B, which projects from the housing 101 and is placed in contact with other end side face of recording head 1, and 23 is a presser bar spring for restraining the position of recording head 1 in the directions as indicated by an arrow A, which projects from one housing wall 101C and is placed in contact with an end face of recording head 1 on the hand of that wall. 24A and 24B are rotatable eccentric top members stood on the positioning surface 101A, comprising eccentric cams 26A and 26B abutting the head 1, in which the rotation operation of the eccentric top member 24A causes an end portion of recording head 1 on this side to be slightly moved via the cam 26A in the direction as indicated by an arrow B. Also, the rotation operation of the eccentric top member 24B causes an end portion of recording head 1 on this side to be slightly moved via the cam 26B in the direction as indicated by an arrow A.

Thus, in the recording head position adjustment mechanism constructed in such manner each recording head 1 is inserted fittingly into corresponding heat pipe 2 from the upperpart of housing 101, with the heat pipe 2, 2A being attached to the housing 101, so that the heat pipe 2 is retained between the biasing member 8 formed of a leaf spring attached to the recording head 1 and the recording head 1. At the same time, the head securing pin 25 provided on the housing positioning surface 101B is fitted into a long hole 1B of head 1, and both end portions of recording head 1 on the hand of discharge port face 1A are placed into contact with the positioning surfaces 101A and 101B of housing, in order to position the head 1 in the direction as indicated by an arrow C.

In this state, one end of recording head 1 in the longitudinal direction is placed in contact with the presser bar spring 23, while the other end thereof is restrained by the presser bar spring 22 and the eccentric top members 24A and 24B. Thereby, rotation operation of the eccentric top member 24A allows the position of each recording head 1 to be adjusted in the directions as indicated by an arrow A, while the rotation operation of the eccentric top member 24B allows the position of an end portion abutting the eccentric cam 26B of recording head 1 to be finely adjusted around the head securing pin 25 in the directions as indicated by an arrow B, whereby with the above operations, the fine adjustment for each mounting position of the recording head can be accomplished so as to correct for drifts between images recorded in different colors, for example, by recording heads 1, and obtain the recording of an image with higher quality.

Next, referring to FIGS. 2B and 2C again, the adjustment means for the warpage of recording head 1 will be described.

Figure 11A:
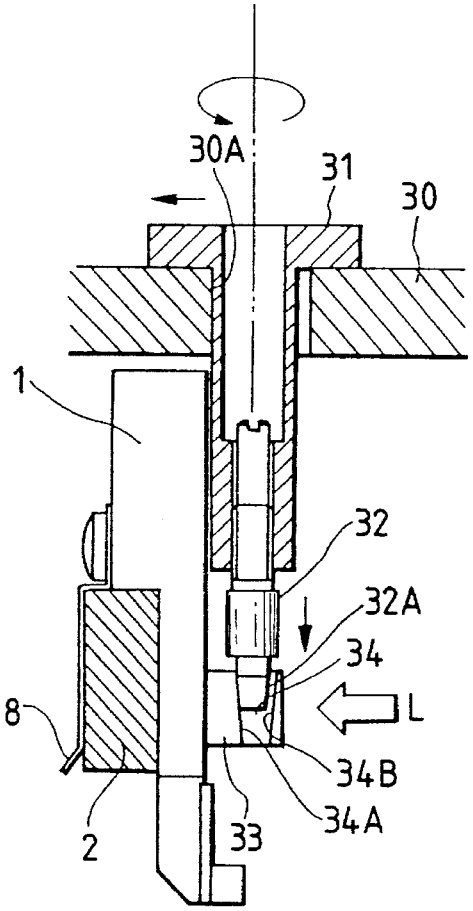
FIGS. 11A and 11B are cross-sectional views showing a warpage regulation mechanism of a recording head according to an example of the present invention.
Figure 11B:
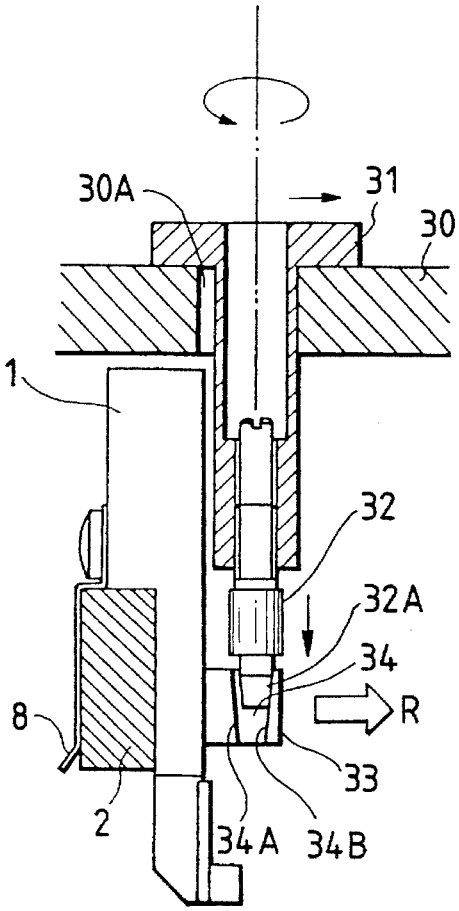

In these figures, 30 is a fixed block mounted across an almost central portion on the upper face of housing wall 101C, and 31 is a slide block fitted into the fixed block 30, wherein the slide block 31 is located on an upper plane of each recording head 1, and can be moved in the direction orthogonal to the longitudinal direction of recording head 1 as indicated by an arrow, owing to a slide block supporting hole 30A as shown in FIGS. 11A and 11B. 32 is a screw member for the adjustment of warpage which is threadedly engaged within the slide block 31, and 32A is a taper portion formed on a tip portion of the screw member 32. On the other hand, each recording head 1 is provided with a warpage adjustment unit 33 at a position corresponding to the slide block 31 and the screw member 32 on an almost central portion in the longitudinal direction, in which the taper portion 32A of screw member 32 is introduced into an aperture 34 of the adjustment unit 33. 34A and 34B are respective taper surfaces formed within this aperture 34.

Figure 12A:
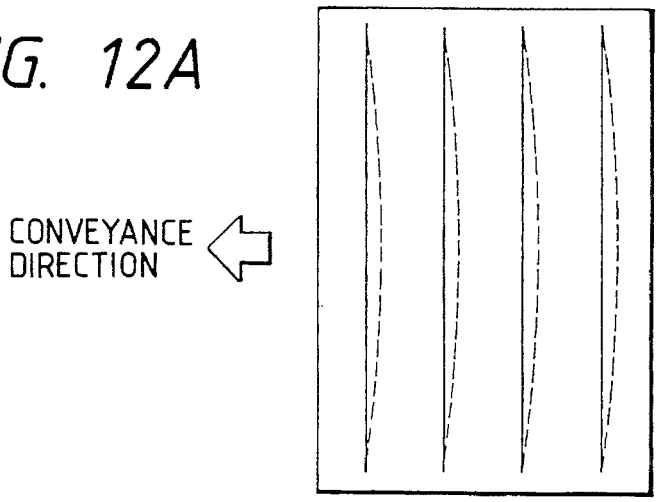
FIGS. 12A–12C are typical views for explaining the warpage of a recording head in connection with the warpage regulation mechanism as shown in FIGS. 11A and 11B.
Figure 12B:
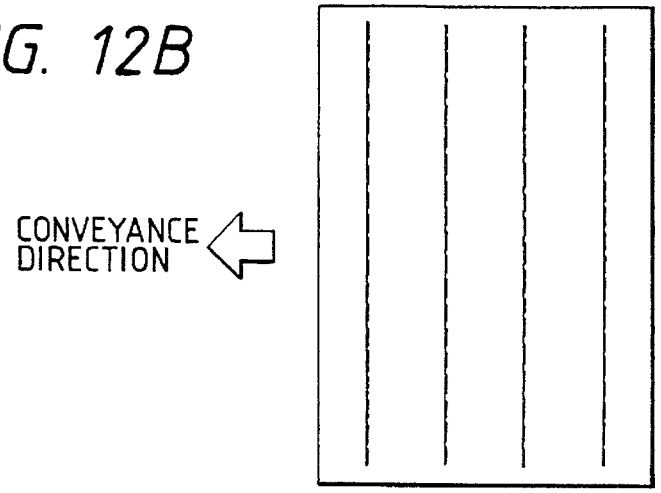
Figure 12C:
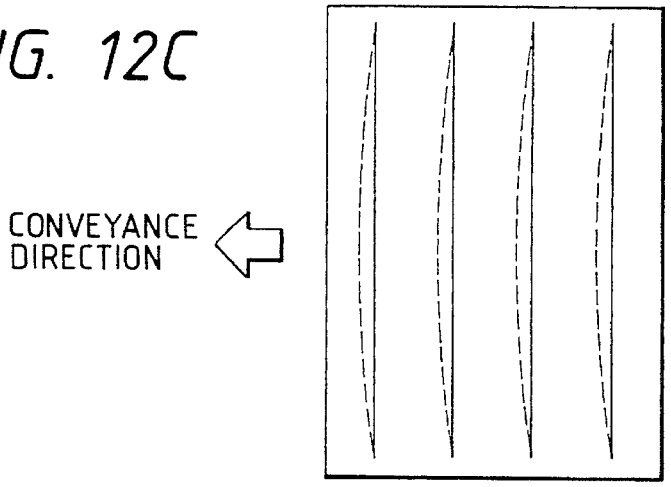

By the way, in the ink jet recording apparatus having the full-line type recording head 1 as above described, the larger the recording head 1, the more warpage occurs in the conveyance direction of recording medium. Thus, if the recording is performed while containing the warpage, there occurs some distortion, as shown by the broken lines in FIGS. 12A and 12C. Using the warpage adjustment means of this example, such a warpage of recording head can be easily adjusted to obtain a normal record image as shown in FIG. 12B, wherein in one recording head 1, when it is required to adjust the warpage in the direction as indicated by an arrow L in FIG. 11A, the slide block 31 is placed at the position as shown, and the screw member 32 is operated so as to press the taper portion 32A of screw member 32 onto the taper surface 34A of warpage adjustment block 33, so that a central portion of recording head 1 can be pushed forth in the L direction together with the heat pipe 2. On the contrary, when it is required to adjust the warpage in the right direction as indicated by an arrow R, the screwing operation with the screw member 32 can be performed so as to press the taper portion 32A of screw member 32 onto the taper surface 34B of warpage adjustment block 33 as shown in FIG. 11B. Note that the above warpage adjustment means can be used not only for removing the warpage completely, but also for regulating the warpage of a plurality of recording heads to make them equal.

Figure 16A:
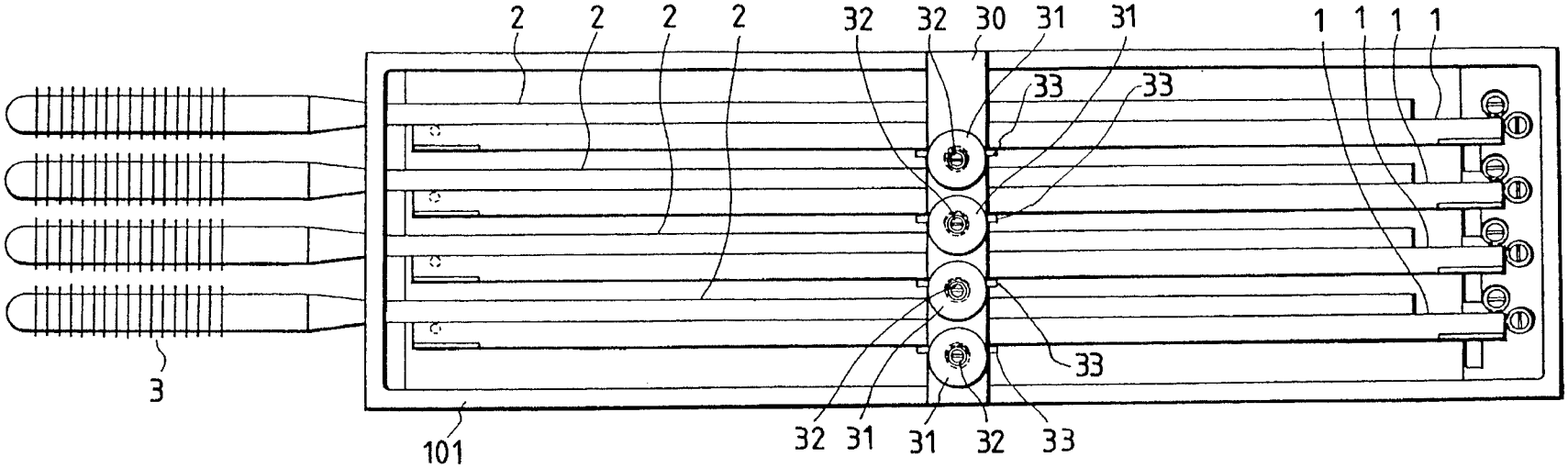
FIGS. 16A and 16B are an upper view and a side cross-sectional view showing a unit consisting of a recording head and a heat pipe as shown in FIG. 2, according to another example of the present invention.
Figure 16B:
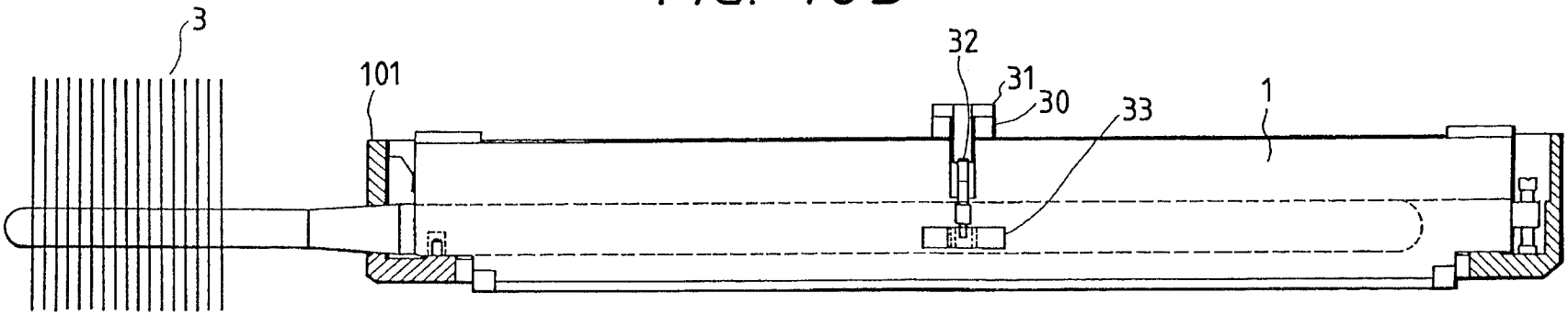

While the example as above described deals with the position and warpage adjustments for the recording head in which a plurality of heat pipes 2 are mutually communicated at the end portions 2A, the present invention is not limited to such a recording head comprising the heat pipe constituted as above, but is also applicable to an arrangement as shown in FIGS. 16A and 16B, in which each heat pipe 2 is carried separately on the housing 101, and the recording head 1 is mounted on each heat pipe 2, and further applicable to an arrangement in which a single full-line type recording head and heat pipe are joined.

By using the warpage adjustment means as above described together with the position adjustment mechanism as previously described, a complete registration is accomplished, whereby it is possible to provide an ink jet recording apparatus which can remove the distortion of a recorded image due to warpage of the recording head, or color drifts in a color image.

Furthermore, it is also configured so that the spacing between a recording medium and the recording head 1 is adjusted by constructing the eccentric top member 24A or the eccentric top member 24B as a double-threaded structure, and moving slightly an end portion of recording head 1 upward or downward via cam 26A or 26B.

Figure 13A:
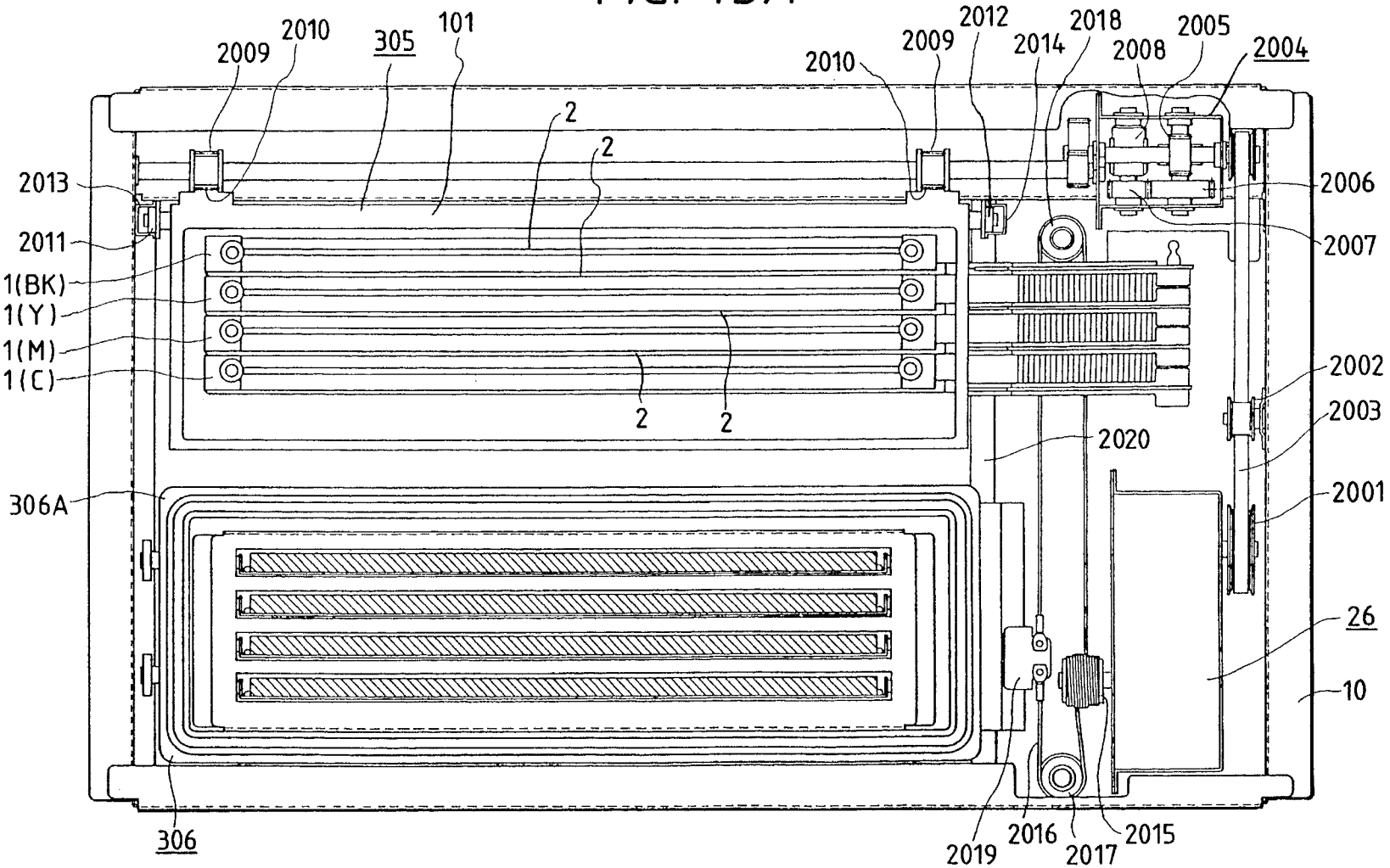
FIGS. 13A and 13B are upper cross-sectional views showing a movement mechanism for a recording head unit and a recovery unit, according to an example of the present invention.
Figure 13B:
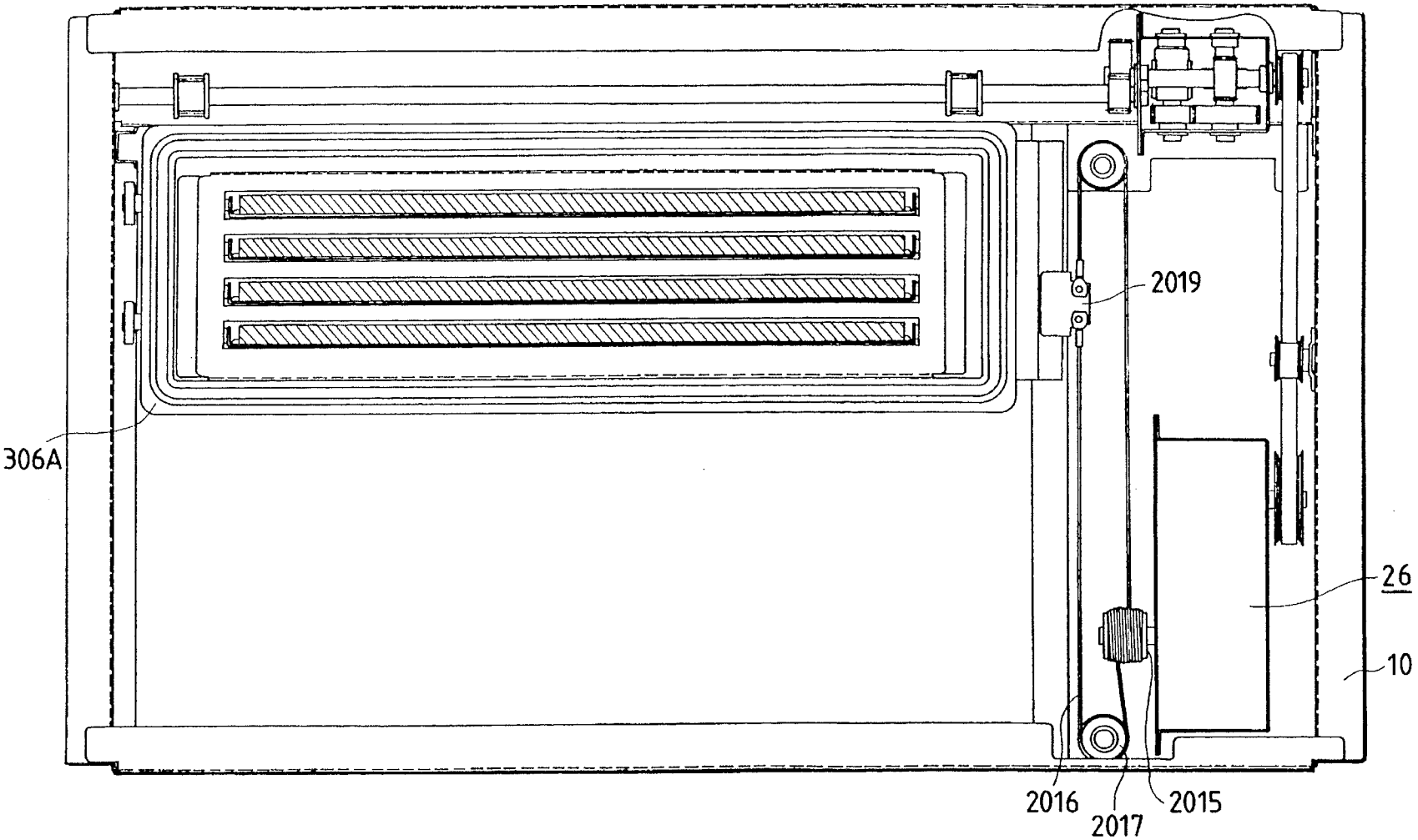
Figure 13C:
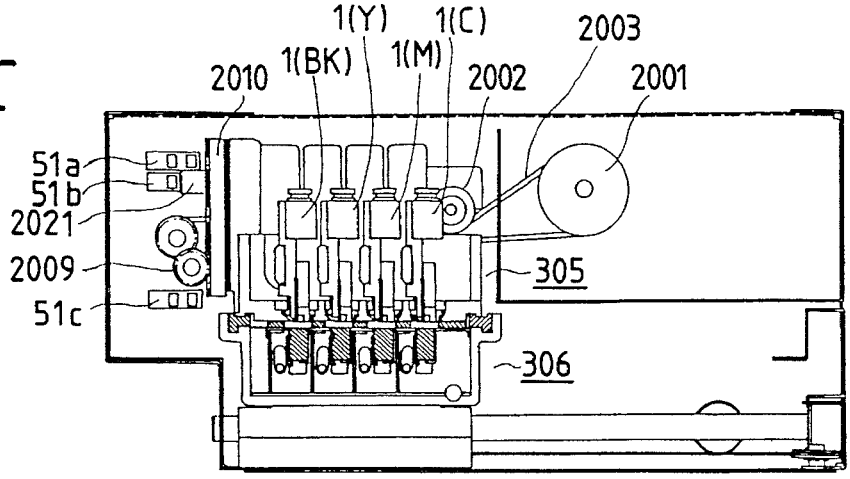
FIGS. 13C–13E are side cross-sectional views showing movement positions of a recording head unit and a recovery unit, with the movement mechanism as shown in FIGS. 13A and 13B.
Figure 13D:
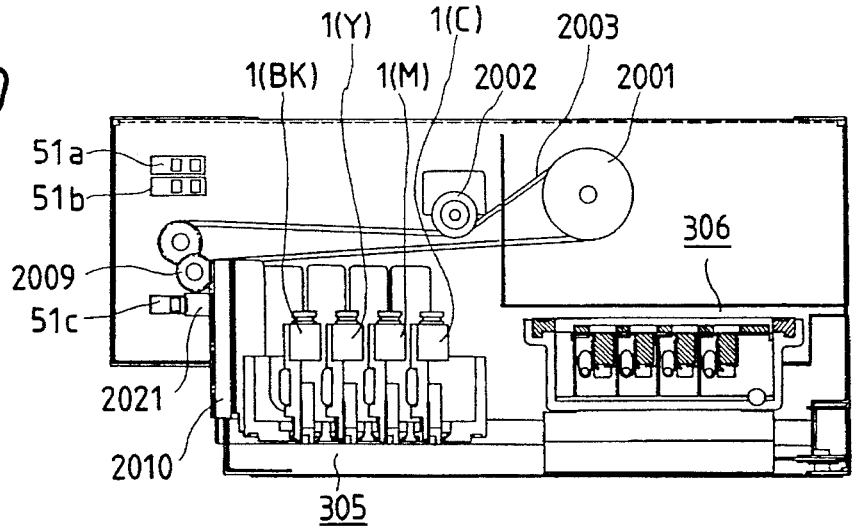

FIGS. 13A–13E are views for explaining the movement mechanism for a unit composed of the recording head and the heat pipe, and specifically, FIG. 13A is a schematic upper view showing a recording head unit 305 and a recovery unit 306, and a driving system for them, FIG. 13B is a schematic upper view showing the recovery unit 306 and the driving system, and FIGS. 13C–13D are schematic cross-sectional views for explaining the relative movement between the recording head unit 305 and the recovery unit 306.

The recording head 305 and the recovery unit 306 of this example are moved simultaneously from the recording position and appropriately placed in order to carry out the capping which is performed to maintain proper ink discharge at all times, or the recovery operation in the capping state.

In FIGS. 13A and 13B, 26 is a recovery unit driving system, in which the driving force is transmitted via belt pulleys 2001, 2002 and a timing belt 2004 to a recording head unit driving system 2004. The head unit driving system 2004 has an arrangement of a pair of helical gears 2005 with a helix angle of 45° for transforming the driving direction to its normal direction, spur gears 2006, 2007, and worm reduction gear 2008, in which the driving force input by the belt is transmitted finally via a train of spur gears to a rack gear 2009. The driving force of rack gear 2009 is transmitted to a rack 2010 provided at two locations on the lengthwise side of housing 101 forming a rectangular frame shape, and transformed into the movement in the vertical direction of housing 101. The housing 101 is provided with rollers 2011, 2012 on its front and rear sides, in which the upward or downward movement of housing 101, i.e., the vertical movement of recording head and heat pipe, can be achieved by the rollers which move along inner surfaces of rails 2013, 2014 for movement of head unit, respectively. Thereby, the housing 101 is movable only by the driving force from a driving source in virtue of a characteristic of the worm reduction gear, which prevents an accident such as a natural dropping of the recording head itself due to the weight of a plurality of heads contained within the housing 101, whereby it is possible to fix the position of the head unit at a position when the driving of motor is stopped.

The heat pipe 2, 2A is supported by a shorter frame of housing 101 in the vicinity of the place where the rack gear 2009 and rollers 2012 are disposed. Accordingly, in this example, the setting is made such that the center of gravity (balance area) for the unit consisting of recording head 1 and heat pipe 2, 2A is located in the neighborhood of a portion for supporting the head pipe 2, 2A. Thereby, it is possible to relieve the vibration of recording head 1 or heat pipe 2, 2A which may occur due to the acceleration or deceleration when the head unit 305 moves for the capping. This relief of vibration can avoid the unnecessary flow of the working fluid especially within the head pipe, and thereby, it is possible to control the temperature of the recording head by use of the heat pipe continually, even during the capping operation, for example. The load of motor can be also relieved.

Figure 13E:
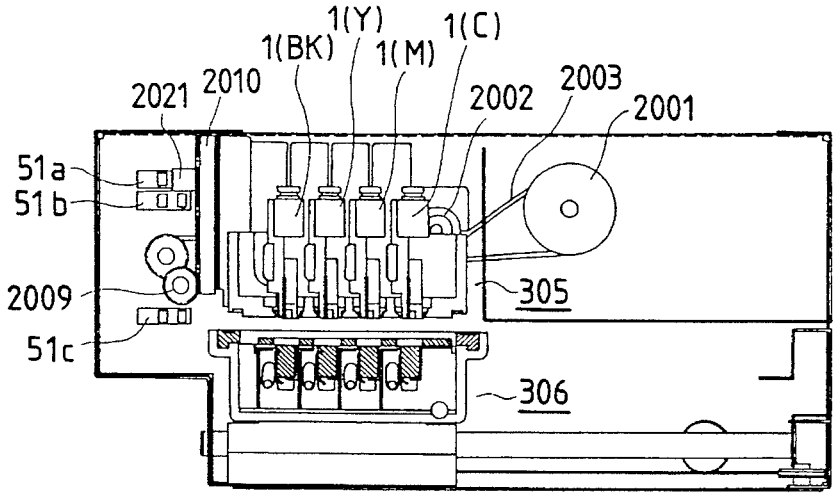

FIGS. 13C and 13E are cross-sectional views showing the essential portion of a head unit movement mechanism. The recording head has three positions of ① head recovery position (capping position), ② recording position, and ③ escape position. FIG. 13C shows ① head recovery position (capping position), FIG. 13D shows ② recording position, and FIG. 13E shows ③ escape position. The detection of each position can be accomplished correctly upon a shade plate 2021 intercepting the light on the detection portion of each of sensors 51*a*–51*c* arranged corresponding to each stop position.

Next, the driving mechanism of the recording head recovery unit 306 will be described. As shown in FIGS. 13A and 13B, 26 is a recovery unit driving system, in which the driving force is transmitted to a driving wire pulley 2015. The driving wire pulley 2015 has a driving wire wound and passed between tension pulleys 2017, 2018, both ends of the wire being attached to a wire laying member 2019 mounted on a recovery container 306A. The recovery container 306A has a rear portion which is slidable via a slide bearing (not shown) on a slide shaft 2020, and a front portion which is slidable on a rail 2031 by means of a slide roller 2030. Thus, the driving with the driving system is transformed into a reciprocative motion of recovery container 306A, thereby moving the recovery container 306A from the recovery position or capping position to the escape position.

The stop position of recovery container 306A is either a recovery position as shown in FIG. 13B or an escape position as shown in FIG. 13A, in which each position can be correctly detected upon the shade plate (not shown) attached to the recovery container 306A intercepting the light on the detection portion of sensor such as a photo interrupter arranged corresponding to each stop position.

FIG. 14A is a flowchart showing a processing procedure for the temperature control of a recording head with a control configuration of this example as shown in FIGS. 2 and 5.

In this processing, at step S101, a predetermined amount of recording operation, for example, the recording operation for one line with each recording head, is performed, and then, at step S103, a determination is made whether or not the temperature of sensor 5 is equal to or more than a predetermined temperature (e.g., 50° C.). Here, if a positive determination is made, the fan 4 is driven and the heater 6 is turned off (if it has been driven), at step S105. After this processing or when a negative determination is made at step S103, the routine proceeds to step S107, where a determination is made whether the temperature T as above indicated is equal to or less than a predetermined temperature $T_2$ (e.g., 45° C.). Here, if a positive determination is made, the heater 6 is driven and the fan 4 is turned off (if it has been driven), at step S109. Then, at step S111, a determination is made whether or not the recording operation has been terminated, and if a positive determination is made, this processing is ended, or if a negative determination is made, the routine returns to step S101 to perform a predetermined amount of recording operations.

The processing of this example as above described is one in which a single temperature sensor 5 is provided on the connection portion of heat pipe 2A which is a portion where four heat pipes 2 are integrated, as shown in FIG. 2. As previously described, if remarkable temperature differences between four recording heads occur, the temperature sensor is provided for each recording head. The processing procedure for the temperature control in this case is shown in FIG. 14B.

After the recording operation at step S201, at each step S203–S209, a determination is made as to whether the temperature $T_{BK}$, $T_Y$, $T_M$ or $T_c$ detected by the temperature sensor provided corresponding to each recording head is equal to or more than a predetermined temperature $T_1$ as above indicated. In these determinations, if there is any recording head whose temperature is equal to or more than a predetermined temperature $T_1$, the fan 4 is turned on, at step S211. Next, at each step S213–S219, a determination is made as to whether the temperature $T_{BK}$, $T_Y$, $T_M$ or $T_c$ detected therein is equal to or less than a predetermined temperature $T_2$ as above indicated.

In these determinations, if there is any positive determination, the routine proceeds to step S221, where a determination is made as to whether or not the fan is off. Only if the fan driving is off, is the heater turned on, at step S223. Thus, the fan and the heater cannot be driven simultaneously. That is, by giving priority to driving of the fan, unnecessary heating of recording head due to the heat driven is avoided.

If it has been determined that all the temperatures of four recording heads are equal to or less than a predetermined temperature $T_2$, the fan is turned off at step S225.

Figure 15A:
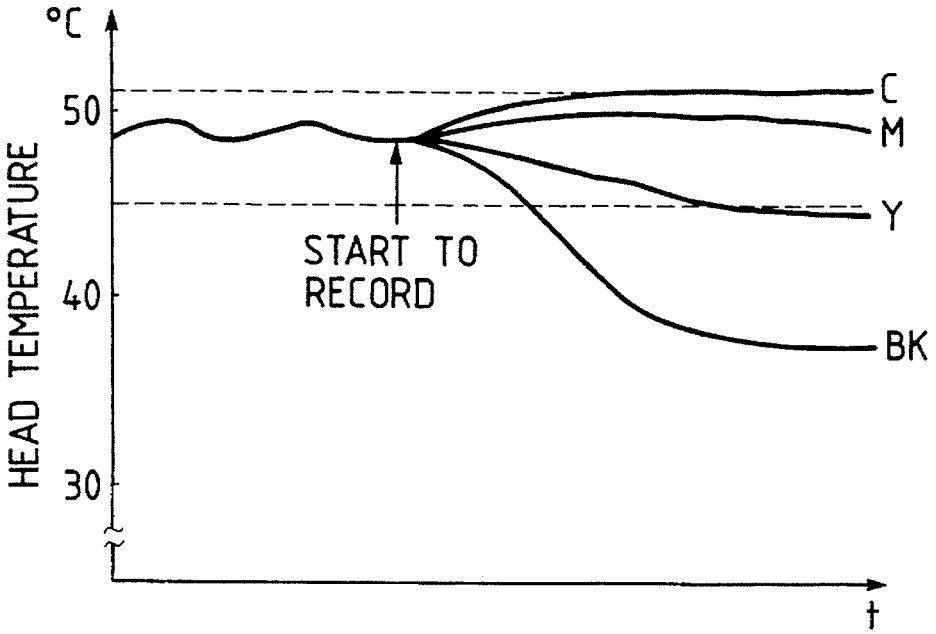
FIGS. 15A and 15B are graphs showing the variations of the temperature of a recording head and the record image density, respectively, with the temperature control as shown in FIGS. 14A–14C.

When an image with high duty, e.g., an image with the recording duty of Bk=10%, C=80%, M=70% or Y=20% for each ink, is recorded according to the control procedure as shown in FIG. 14B, the temperature variation of recording head is illustrated in FIG. 15A. As seen from the figure, the temperature decrease of a recording head with lower duty (Y, Bk) is significant. This temperature decrease causes the density variation of image to be increased.

Figure 15B:
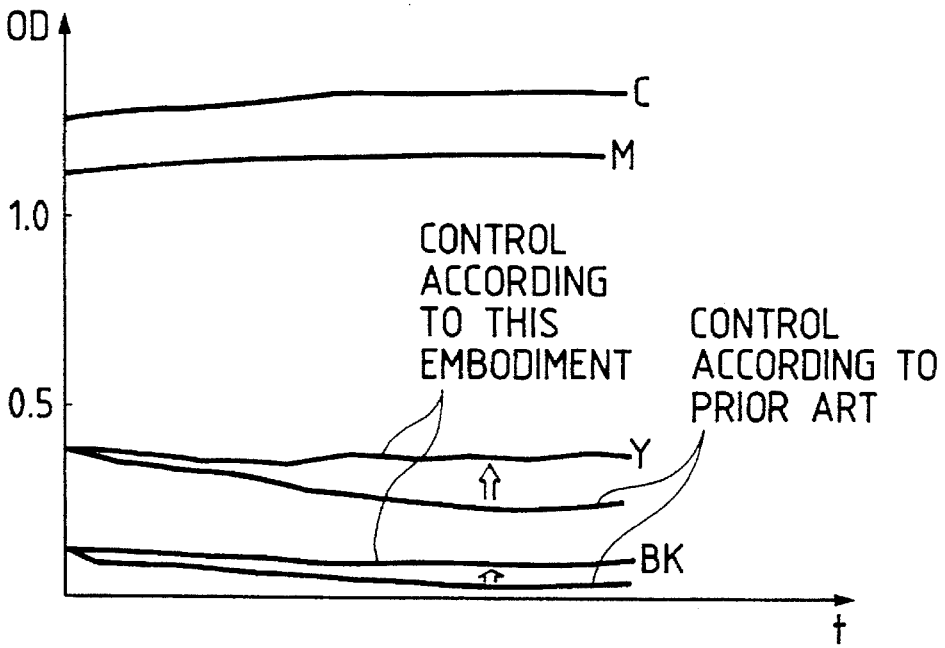

On the contrary, in addition to the control as shown in FIG. 14B, using the driving signal waveform of each recording such as,

| | Voltage | Pulse Width |
|---|---|---|
| $T_{C,M,Bk} < 40°$ C. | 35 (V) | 7 (μs) |
| $T_{C,M,Bk} < 45°$ C. | 33 (V) | ↑ |
| $T_{C,M,Bk} \geqq 45°$ C. | 31 (V) | ↑ |

the voltage of driving pulse is changed depending on the temperature of each head. Thereby, more uniform densities for an image are attained as shown in FIG. 15B.

While in the above example, the voltage of driving pulse is changed, the width of the driving pulse can be changed to obtain the same effects. For example,

| | Voltage | Pulse width |
|---|---|---|
| $T_{C,M,Bk} < 40°$ C. | 31 (V) | 9 (μs) |
| $T_{C,M,Bk} < 45°$ C. | ↑ | 8 (μs) |
| $T_{C,M,Bk} \geqq 45°$ C. | ↑ | 7 (μs) |

whereby the same effects can be obtained.

By using the two-division driving pulse, a more stable image can be obtained.

For example,

| | Voltage | Pulse width |
|---|---|---|
| $T_{C,M,Bk} \leqq 35°$ C. | 31 (V) | 2 division, 4+ (rest 3) +5 (μs) |
| $T_{C,M,BK} < 40°$ C. | ↑ | No division 9 (μs) |
| $T_{C,M,BK} < 45°$ C. | ↑ | No division 8 (μs) |
| $T_{C,M,BK} \geqq 45°$ C. | ↑ | No division 7 (μs) |

whereby greater effects can be obtained.

Figure 14C:
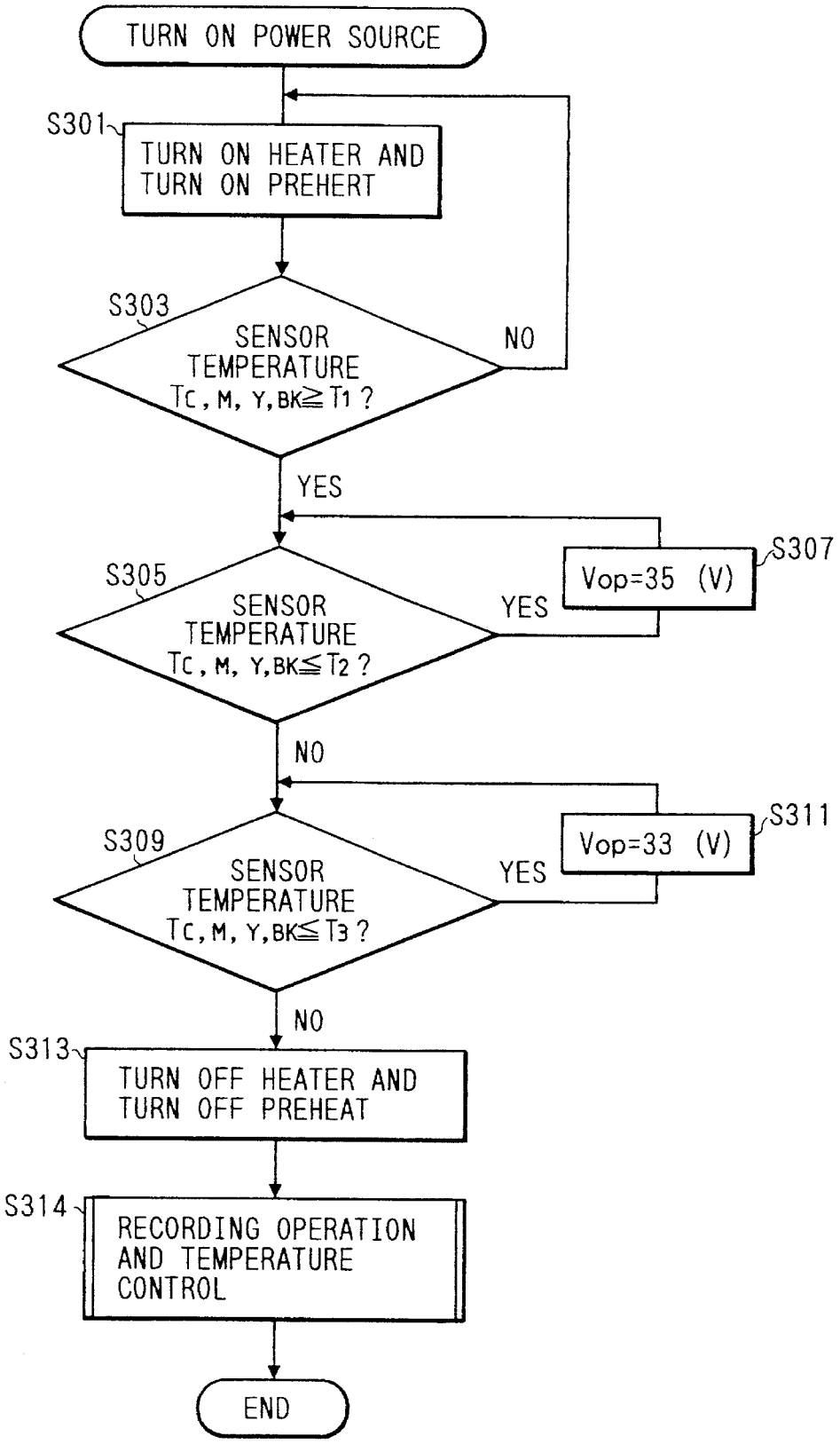

Moreover, since the heat pipe used in this example has a comparatively large heat capacity, it takes a longer warm-up time for the temperature of recording head to reach one at which the recording can be started after the power of apparatus is turned on. Accordingly, if the head heating process is carried out by means of the heat pipe as shown in FIG. 14C, during the warming up, the warm-up time can be greatly shortened (e.g., 2 min.–40 sec.).

In accordance with the determinations of head temperature which are performed at steps S305, S309, the driving voltage for preheating the heat pipe is set. For example, if the head temperature is relatively low, the preheating is performed at a greater voltage.

FIGS. 16A and 16B are a schematic upper view and a schematic side cross-sectional view, respectively, showing another example of a recording head unit consisting of recording heads 1, heat pipes 2, and a housing 101 for supporting them.

The constitution of this example differs from the aforementioned example in that four heat pipes 2 are not integrated at their end portion, but are independently provided, and accordingly, the fins 3 are separately provided. However, the constitution or effect as described in each section in connection with the above example is provided in the same way except that the attachment positions or the number of temperature sensors and heaters are different from those of the above-mentioned example.

While in the example as above described, an ink jet recording apparatus has been explained, it should be noted that the application of heat pipe according to the present invention is not limited to such a method, but may be also possible to the thermal recording or thermal imprint recording method.

The present invention brings about excellent effects particularly in an ink jet recording apparatus having an ink jet recording head of the ink jet system for recording by forming fine liquid droplets with that heat energy among the various ink jet recording system.

As to its representative constitution and principle, for example, one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal which gives rapid temperature elevation exceeding nucleus boiling in recording liquid corresponding to the recording information on electricity-heat converters arranged corresponding to the sheets or liquid channels holding a recording liquid (ink), heat energy is generated at the electricity-heat converters to effect film boiling in the recording liquid near the heat acting surface of the recording head, and consequently the bubbles within the recording liquid can be formed corresponding one by one to the driving signals. By discharging the recording liquid through an opening for discharging to the atmosphere by the action force arising in the growth and shrinkage process of the bubble, at least one droplet is formed. By making the driving signals into pulse shapes, growth and shrinkage of the bubble can be effected instantly and adequately to accomplish more preferable discharging of the recording liquid with a particularly excellent response characteristic. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination of the discharging orifice, liquid channel, and electricity-heat converter (linear liquid channel or right-angled liquid channel) as disclosed in the above-mentioned respective specifications, the constitution by use of U.S. Pat. No. 4,558,333 or 4,459,600 disclosing the constitution having the heat acting portion arranged in the flexed region is also included in the present invention.

Further, as the recording head of the full type having a length corresponding to the maximum width of a recording medium which can be recorded by the recording device, either the constitution which satisfies its length by a combination of a plurality of recording heads as disclosed in the above-mentioned specifications or the constitution as one recording head integrally formed may be used, and in either case, the present invention can exhibit the effects as described above further effectively.

In addition, the present invention is effective for a recording head of the freely exchangeable chip type which enables electrical connection to the main device or supply of ink from the main device by being mounted on the main device, or a recording head of the cartridge type having an ink supply tank integrally provided on the recording head itself.

Also, addition of a restoration means for the recording head, a preliminary auxiliary means, etc. provided as the constitution of the recording device of the present invention is preferable, because the effect of the present invention can be further stabilized. Specific examples of these may include, for the recording head, capping means, cleaning means, pressurization or suction means, electricity-heat converters or another type of heating element, or preliminary heating means according to a combination of these, and it is also effective for performing stable recording to perform preliminary mode which performs predischarging separate from recording.

Further, as the recording mode of the recording device, the present invention is extremely effective for not only the recording mode of a primary color such as black etc., but also a device equipped with at least one of plural different colors or full color by color mixing, whether the recording head may be either integrally constituted or combined in plural number.

In addition, the recording apparatus using an ink jet recording head according to the present invention may be provided in the form of not only an image output terminal for an information processing equipment such as a computer, but also a copying machine in combination with a reader, and further, a facsimile terminal equipment having the transmission and reception feature.

Figure 17:
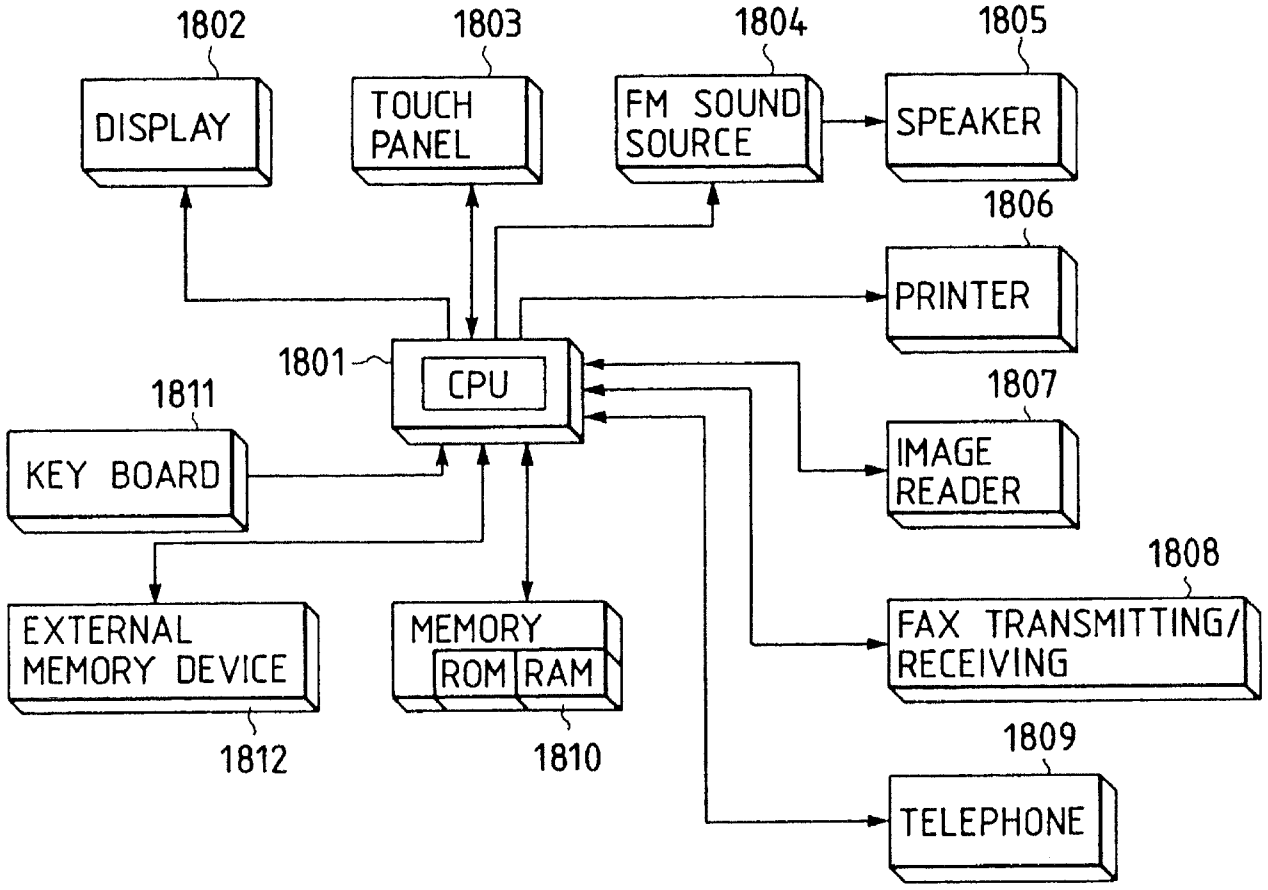
FIG. 17 is a block diagram showing a schematic configuration in which a recording apparatus of the present invention is applied to the information processing apparatus.

FIG. 17 is a block diagram showing a schematic configuration in which a recording apparatus of the present invention is applied to the information processing apparatus having the feature of a word processor, personal computer, facsimile terminal equipment, and copying machine.

In the figure, 1801 is a control unit for controlling the whole apparatus, wherein it comprises CPU such as a microprocessor or various I/O ports, and controls by outputting or inputting control or data signals to or from each of sections, respectively. 1802 is a display section, which displays various menus, document information, and image data read with an image reader 1807 on the display screen. 1803 is a transparent, pressure sensitive touch panel provided on the display section 1802, which enables the entry of items or coordinate values on the display section 1802 by depressing its surface with a finger or the like.

1804 is a FM (Frequency Modulation) sound source section, which makes the FM modulation for the music information created with the music editor, which is stored in the memory 1810 and the external storage device 1812 as the digital data. An electrical signal from the FM sound source section 1804 is converted into an audible sound by a speaker section 1805. A printer section 1806 is useful as the output terminal for the personal computer, a facsimile terminal equipment, or a copying machine, to which the present invention is applied.

1807 is an image reader section which inputs by reading original data photoelectrically, and is provided midway on the conveying path of original to read facsimile or copying original, and other various types of originals. 1808 is a facsimile (FAX) transmission or reception section for transmitting original data read by the image reader section 1807 with the facsimile or receiving and decoding facsimile signals that are transmitted, having an interface facility with the outside. 1809 is a telephone section, comprising various telephone features, such as ordinary telephone function or automatic answering telephone function.

1810 is a memory section comprising a ROM for storing system programs, manager programs and other application programs, character fonts, and dictionary, as well as application programs loaded from the external storage device 1812, document information, and a video RAM.

1811 is a keyboard section for inputting document information or various commands.

1812 is an external storage device which is a storage medium consisting of the floppy disk or hard disk, and is used to store document information, music or audio data, and user's application programs.

Figure 18:
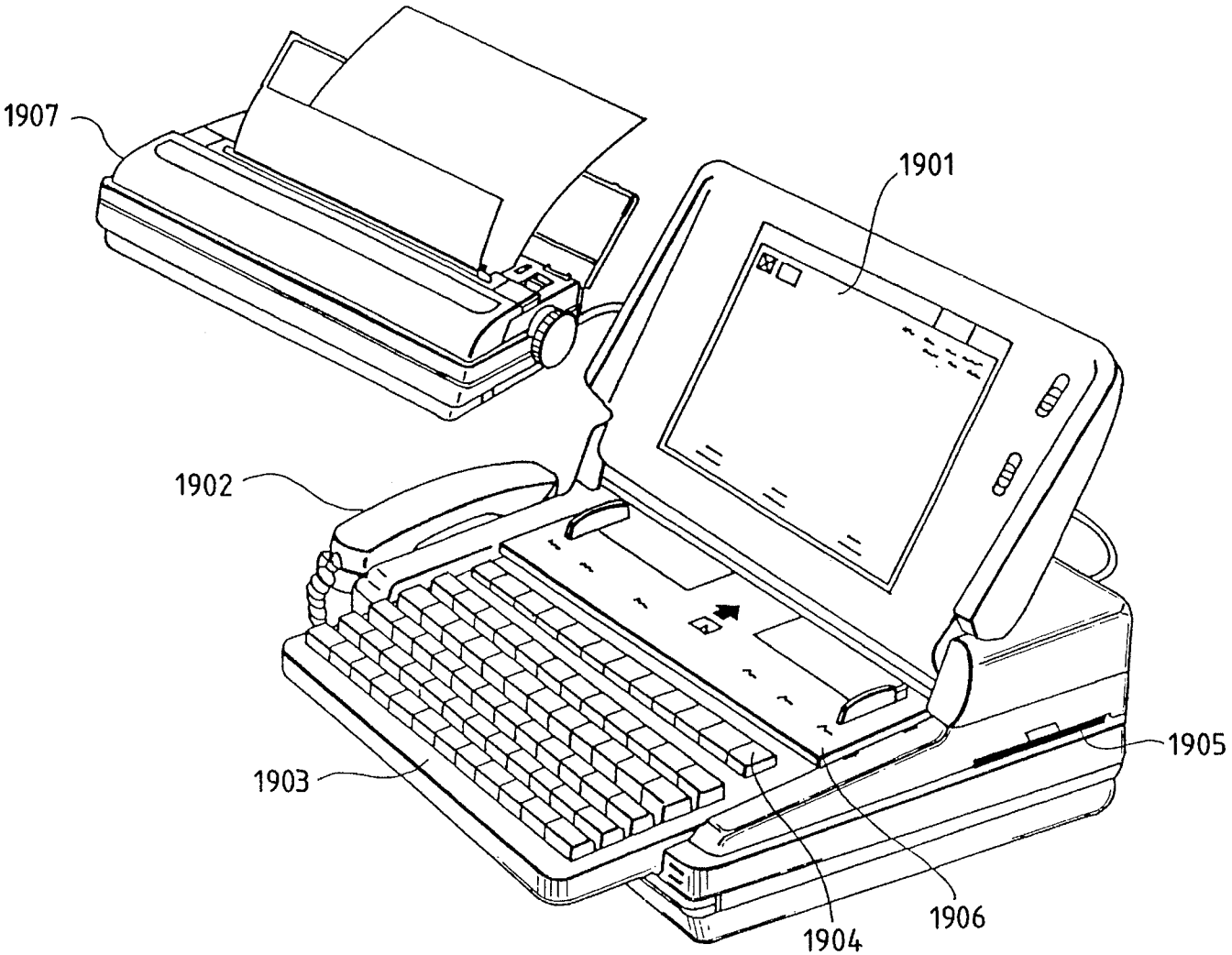
FIG. 18 is a typical appearance view of the information processing apparatus as shown in FIG. 17.

FIG. 18 is a typical appearance view of the information processing apparatus as shown in FIG. 17.

In the figure, 1901 is a flat panel display using a liquid crystal, for displaying various menus, graphic data or documents. On this display 1901 is installed the touch panel 1903, which enables the entry of coordinates or item specifications by depressing a surface of the touch panel 1903 with a finger or the like. 1902 is a handset to be used when the apparatus functions as a telephone. The keyboard 1903 is detachably connected via a cord to the main body, and is used to input various documents or data. The keyboard 1903 is also provided with various types of function keys 1904. 1905 is an opening for insertion of the floppy disk into the external storage device 1812.

1906 is a paper stack section for stacking papers to be read by the image reader section 1807, in which a read paper is exhausted from the rear portion of the device. In facsimile reception, received data is recorded by the ink jet printer 1907.

It should be noted that the display section 1802 as above described may be a CRT, but is preferably a flat panel of the liquid crystal display type using a ferroelectric liquid crystal. This is because it can be more compact, thinner, and lighter.

When the above mentioned information processing unit functions as a personal computer or word processor, various information input from the keyboard 1811 is processed according to a predetermined program in the control section 1801, and output to the printer 1806 as images.

When it functions as a receiver for the facsimile terminal equipment, the facsimile information input from the FAX transmission and reception section 1808 via the transmission line is received and processed according to a predetermined program in the control section 1801, and output to the printer section 1806 as a received image.

And when it functions as a copying machine, an original is read by the image reader section 1807, and original data that was read is output via the control section 1801 to the printer section 1806 as a copied image. Note that when it functions as a transmitter for the facsimile terminal equipment, original data that was read by the image reader section 1807 is processed for transmission according to a predetermined program in the control section 1801, and then transmitted via the FAX transmission and reception section 1808 to the transmission line.

Figure 19:
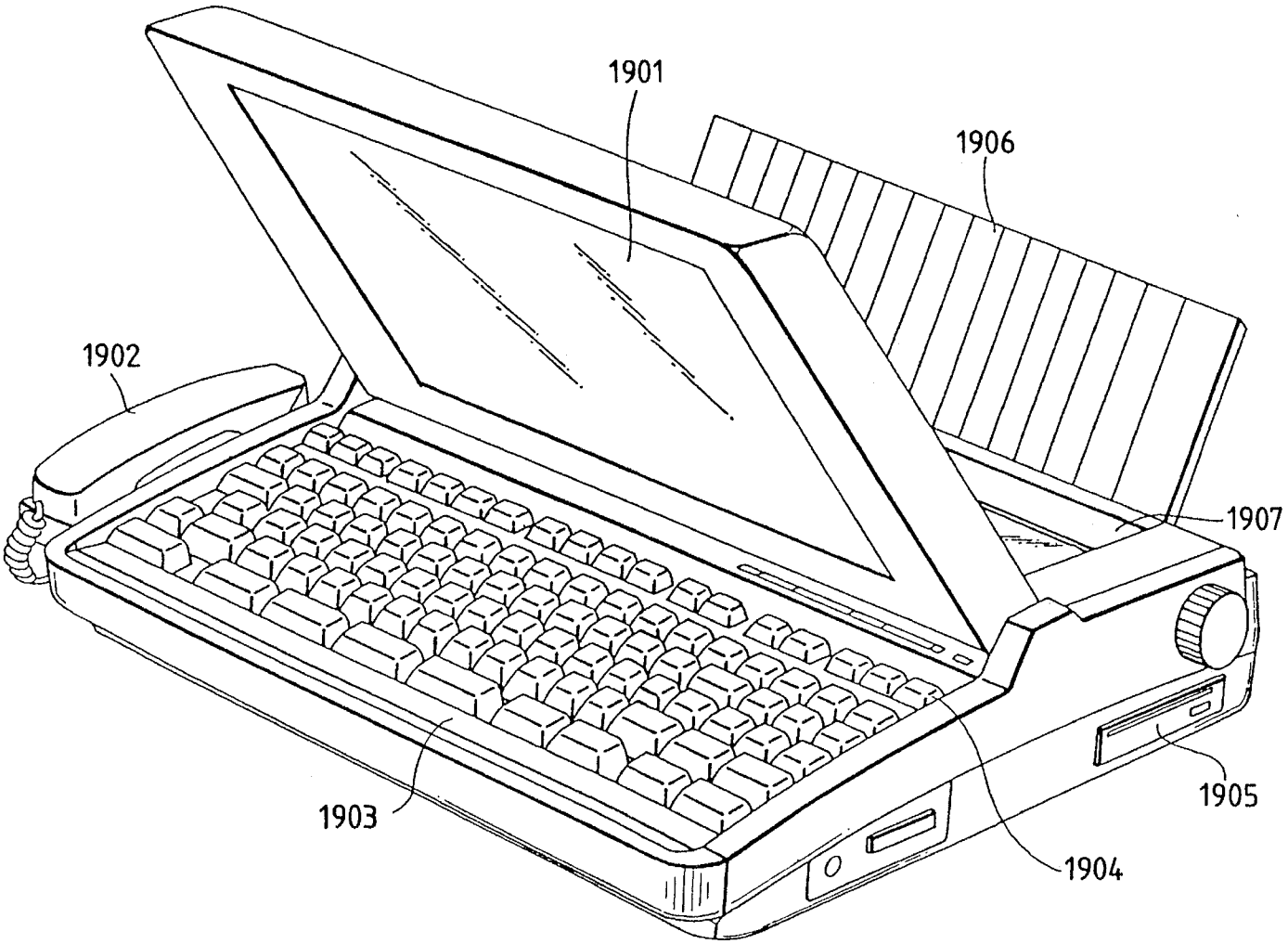
FIG. 19 shows an apparatus in which an ink jet printer is integrally incorporated into the information processing apparatus as shown in FIG. 18.

It should be noted that the above mentioned information processing device can be an integral type containing an ink jet printer within the main body, as shown in FIG. 19, in which its portability can be enhanced. In the same figure, like reference numerals are affixed to parts having the same functions as those in FIG. 18.

As above described, if a recording apparatus according to the present invention is applied to the multifunction information processing device as above described, higher quality recording images can be obtained so that the functions of the information processing device can be further improved.

As can be clearly understood from the above description, according to the present invention, the working fluid within the heat pipe and its vapor are separated almost completely by the partition plate, so that for example, even if the temperature change due to the condensation of vapor in the heat radiation unit of the heat pipe is transmitted over the interior of the heat pipe because of its rapid heat transport, the temperature equalization action with the working fluid is not affected, whereby respective operations can be achieved independently.

Also, the working fluid within the heat pipe is prevented from deflecting, for example, when the heat pipe is inclined during its operation.

Moreover, the movement of vapor will not wipe away the working fluid.

As a result, the efficiency of heat exchange over the heat pipe can be improved.

Further, according to the present invention, the air flow around the fins is made turbulent due to the existence of the slit plates and slits, and due to that turbulent flow, the heat of fins are efficiently radiated without almost any break away in the flow around the fins, so that the efficient heat radiation can be effected using all the fins.

With the provision of slip plates, the surface area of fins can be increased, thereby improving the heat radiation efficiency of fins.

As a result, temperature control of the recording head can be achieved with high response and precision by the use of fins. Also, the fins can be made smaller, so that the apparatus can be miniaturized.

Furthermore, according to the present invention, the number of heating elements or temperature detection elements can be reduced because they are provided in the vicinity of integral portion of a plurality of heat exchange members, so that the construction for the temperature control of recording heads can be made simpler.

According to another aspect of the present invention, even when the heat exchange elements as above mentioned are integrated, the temperature of the recording head can be controlled within a predetermined range of temperature in accordance with the temperature of an individual recording head.

As a result, the temperature of the recording head can be equalized with a simple control constitution, so that the dispersion of image density can be relieved.

In addition, according to the present invention, by providing a recording head for recording by the use of heat energy generated by heating elements, and heat exchange means including a first heat exchange unit for exchanging the heat with the recording head, which is attached along the longitudinal direction of a recording head without immediate contact with a region where the heating elements are disposed in a substrate of recording head, and a second heat exchange unit for exchanging the heat with the atmosphere, extending from the first heat exchange unit to the outside of the recording region, high quality recording image can be obtained with a stable recording characteristic, because excellent ink discharge can be achieved with the proper bubble generation by suitably controlling the temperature of the recording head using the heat exchange means.

Also, according to the present invention, the movement of the atmosphere around the heat pipe and fins, for example, as a second heat exchange member, is not obstructed by the support member, so that the heat radiation in the second heat exchange member can be efficiently effected. Particularly, when the air current is generated in the atmosphere as above mentioned by the fan, the improvement of heat radiation efficiency becomes more remarkable.

As the support member supports the recording heat unit in the neighborhood of its center of gravity, the relative movement with respect to the recovery unit, for example, in the capping, is made smoother and the working fluid within the heat pipe for example can be always stabilized. Moreover, when the recording head is of a so-called serial type, the scanning movement for recording can be made smoother.

As a result, the temperature distribution of the recording head is reduced, so that an image without density irregularities can be recorded.

In addition, according to the present invention, an ink jet recording apparatus comprising a plurality of recording heads, and capable of the easy temperature control between recording heads, by providing the first heat exchange unit of heat exchange means having the first exchange unit and the second exchange unit along the longitudinal direction of each recording head, and providing position adjustment means for adjusting the relative position of each recording head in the longitudinal direction, and/or spacing adjustment means for adjusting the spacing between adjacent recording heads, and warpage adjustment means for exerting the biasing force to remove the warpage of recording head, by engaging with a side face of recording head on a central portion in the longitudinal direction, with both end portions of each recording head being supported at predetermined positions via the adjustment of the position and spacing adjustment means, the state for obtaining a high quality recorded image can be achieved by carrying out the elimination or reduction of warpage of each recording head as required, as well as the adjustment of registration.

Also, according to the present invention, when the heat exchange member is secured to the support member, for example, the recording head can be attached by inserting the heat exchange member into a space between the recording head and presser member provided therein against a pressing force of the presser member, and detached against the above pressing force.

Conversely, when the recording head is secured thereto, the heat exchange member can be inserted or extracted against the pressing force of the presser member provided on the recording head.

As a result, the attachment or detachment of the recording head to or from the heat exchange member can be performed with a simple operation such as the insertion or extraction, so that the maintainability for service can be improved and its cost can be reduced.

What is claimed is:

1. A recording apparatus for recording onto a recording medium having a recording width by using heat energy, while conveying said recording medium, comprising:

a recording head unit having a balance area;

a recording head having plural heating elements for generating said heat energy, said recording head being included in said recording head unit;

a first heat exchange member for exchanging heat with said recording head and which is joined with said recording head, and which is included in said recording head unit;

a heat exchange unit comprising a second heat exchange member for exchanging heat with an atmosphere and which is provided outside of an area where said recording head is disposed, said second heat exchange member being connected to said first heat exchange member at a connecting section for heat exchange therebetween, and which is included in said recording head unit, said heat exchange unit exchanging heat between said second heat exchange member and said atmosphere;

a support member for supporting at least a vicinity of said balance area of said recording head unit, said first heat exchange member including an end opposite the connecting section between said first and second heat exchange members; and moving means connected to said support member to move said recording head unit between a recording position and a non-recording position, wherein said support member supports at least a vicinity of the balance area of said recording head unit so that said recording unit is supported in a desired balance, thus reducing a load for said moving means.

2. A recording apparatus according to claim 1, wherein said heat exchange unit comprises a fin member for promoting heat exchange between said second heat exchange member and said atmosphere.

3. A recording apparatus according to claim 1, further comprising air flow generating means for generating an air flow in said atmosphere of said second heat exchange member.

4. A recording apparatus according to claim 1, wherein said recording head is a full line head having discharge porous provided on said head in a configuration so as to lie across substantially all of said recording width of said recording medium.

5. A recording apparatus according to claim 1, wherein the balance area of said recording head unit is a connecting area of said heat exchange unit to which said first and second heat exchange members are connected.

* * * * *

UNITED STATES PATENT AND TRADEMARK OFFICE

CERTIFICATE OF CORRECTION

PATENT NO. : 5,486,849

DATED : January 23, 1996

INVENTOR(S) : YASUSHI MIURA ET AL.

It is certified that error appears in the above-identified patent and that said Letters Patent is hereby corrected as shown below:

COLUMN 2

Line 15, "a" should read --an--.

COLUMN 7

Line 1, "mender" should read --member--.
Line 14, "as" should read --a--.

COLUMN 8

Line 17, "member" should read --members--.
Line 24, "head" should read --heads--.
Line 27, "member;" should read --members;--.

COLUMN 10

Line 24, "recording head" should read --recording heads--.

COLUMN 12

Line 30, " head" should read --heads--.

COLUMN 16

Line 53, "area" should read --areas--.
Line 61, "area" should read --areas--.

COLUMN 17

Line 36, "communicate" should read --communicated--.

UNITED STATES PATENT AND TRADEMARK OFFICE

CERTIFICATE OF CORRECTION

PATENT NO. : 5,486,849

DATED : January 23, 1996

INVENTOR(S) : YASUSHI MIURA ET AL. Page 2 of 2

It is certified that error appears in the above-identified patent and that said Letters Patent is hereby corrected as shown below:

COLUMN 30

Line 5, "system." should read --systems--.

COLUMN 34

Line 67, "comprises" should read --further comprises--.

COLUMN 35

Line 9, "porous" should read --ports--.

Signed and Sealed this

Twenty-third Day of July, 1996

*Attest:*

Bruce Lehman

BRUCE LEHMAN

*Attesting Officer*

*Commissioner of Patents and Trademarks*